US011052306B2

(12) United States Patent
Takebayashi

(10) Patent No.: US 11,052,306 B2
(45) Date of Patent: Jul. 6, 2021

(54) WISDOM RING PUZZLE

(71) Applicant: i Subaru Co., Ltd., Joetsu (JP)

(72) Inventor: Koji Takebayashi, Joetsu (JP)

(73) Assignee: i Subaru Co., Ltd., Joetsu (JP)

( * ) Notice: Subject to any disclaimer, the term of this patent is extended or adjusted under 35 U.S.C. 154(b) by 0 days.

(21) Appl. No.: 16/857,444

(22) Filed: Apr. 24, 2020

(65) Prior Publication Data

US 2020/0246685 A1 Aug. 6, 2020

Related U.S. Application Data

(63) Continuation of application No. PCT/JP2018/039316, filed on Oct. 23, 2018.

(30) Foreign Application Priority Data

Nov. 1, 2017 (JP) ..... JP2017-211621

(51) Int. Cl.
*A63F 9/08* (2006.01)

(52) U.S. Cl.
CPC ..... *A63F 9/0876* (2013.01); *A63F 2250/122* (2013.01)

(58) Field of Classification Search
CPC ..... A63F 9/08; A63F 2250/122; A63F 9/06; A63F 9/0602; A63F 2250/127
USPC ..... D21/482
See application file for complete search history.

(56) References Cited

U.S. PATENT DOCUMENTS 1,133,061 A * 3/1915 Quarles ..... A63F 9/0876 273/158
1,589,305 A * 6/1926 Sendek, Jr. ..... A63F 9/0876 273/158
2,998,253 A * 8/1961 Kranzusch ..... A63F 9/0876 273/158

(Continued)

FOREIGN PATENT DOCUMENTS

CA 1171434 A * 7/1984 ..... A63F 9/0876
CA 2114580 A1 * 10/1995 ..... A63F 9/0876

(Continued)

OTHER PUBLICATIONS

Moler, Cleve, "Patience Chinese Rings Puzzle", <https://blogs.mathworks.com/cleve/2017/02/06/patience-chinese-rings-puzzle/>, retrieved on Oct. 27, 2020, dated Feb. 6, 2017. (Year: 2017).*

(Continued)

*Primary Examiner* — Steven B Wong
(74) *Attorney, Agent, or Firm* — Hauptman Ham, LLP

(57) ABSTRACT

The wisdom ring puzzle includes a first member and a second member being an annular member, the first member including a connection post, a first small ring, a second small ring, and a first large ring, and a disconnection prevention part, a first post, and a second post sequentially provided to extend from the connection post toward a substantially same direction, the first post including a first ring catching part, the second post including a second ring catching part, the first small ring swingably caught in the first post by the first ring catching part, the second small ring and the first large ring swingably caught in the second post by the second ring catching part, the disconnection prevention part passing through the first small ring and the first large ring, the first post passing through the second small ring.

8 Claims, 24 Drawing Sheets

(56) References Cited

U.S. PATENT DOCUMENTS

| | | | | | |
|---|---|---|---|---|---|
| 3,198,524 | A | * | 8/1965 | Ringstad | A63F 9/0876 273/158 |
| 3,698,719 | A | * | 10/1972 | Winslow | A63F 9/0876 273/158 |
| 3,706,458 | A | * | 12/1972 | Jones | A63F 9/0876 273/158 |
| D226,017 | S | * | 1/1973 | Marr | D21/482 |
| 3,881,732 | A | * | 5/1975 | Winslow | A63F 9/0876 273/158 |
| 3,997,168 | A | * | 12/1976 | Paige | A63F 9/0876 273/159 |
| 4,000,901 | A | * | 1/1977 | Flores | A63F 9/0876 273/158 |
| 4,036,504 | A | * | 7/1977 | Touchette | A63F 9/0876 273/158 |
| 4,221,386 | A | * | 9/1980 | Wisniewski | A63F 9/0876 273/159 |
| D280,918 | S | * | 10/1985 | Hallmark | 273/158 |
| D294,961 | S | * | 3/1988 | Iancului | 273/158 |
| D305,784 | S | * | 1/1990 | Bertagnoli | D21/482 |
| 4,907,805 | A | * | 3/1990 | Watkins | A63F 9/0876 273/158 |
| 4,957,292 | A | | 9/1990 | Ushiyama | |
| D339,614 | S | * | 9/1993 | Ren | D21/482 |
| D416,950 | S | * | 11/1999 | Reynolds, Jr. | D21/482 |
| D729,324 | S | * | 5/2015 | Chaney | D21/478 |

FOREIGN PATENT DOCUMENTS

| | | | | | |
|---|---|---|---|---|---|
| CH | 118993 | A | * | 2/1927 | A63F 9/0876 |
| DE | 1906715 | A1 | * | 8/1970 | A63F 9/0876 |
| DE | 3214028 | A1 | * | 10/1983 | A63F 9/0876 |
| DE | 3313102 | A1 | * | 10/1984 | A63F 9/0876 |
| DE | 9212631 | U1 | * | 3/1993 | A63F 9/0876 |
| DE | 4404711 | A1 | * | 8/1995 | A63F 9/0876 |
| DE | 4412860 | A1 | * | 10/1995 | A63F 9/0876 |
| DE | 29514217 | U1 | * | 11/1995 | A63F 9/0876 |
| FR | 1172588 | A | * | 2/1959 | A63F 9/0876 |
| GB | 2114009 | A | * | 8/1983 | A63F 9/0876 |
| GB | 2114453 | A | * | 8/1983 | A63F 9/0876 |
| GB | 2117652 | A | * | 10/1983 | A63F 9/0876 |
| GB | 2224944 | A | | 5/1990 | |
| JP | 6112956 | B2 | | 3/2017 | |

OTHER PUBLICATIONS

English translation of Written Opinion of the International Searching Authority (PCT/ISA/237) dated Jan. 22, 2019 for the PCT application No. PCT/JP2018/039316.

International Search Report issued in corresponding International Patent Application No. PCT/JP2018/039316 dated Jan. 22, 2019, along with an English translation.

Written Opinion issued in corresponding International Patent Application No. PCT/JP2018/039316 dated Jan. 22, 2019.

* cited by examiner

3

3

3

4

7

9

WISDOM RING PUZZLE

CROSS REFERENCE TO RELATED APPLICATIONS

This application is based upon and claims the benefit of priority from the prior Japanese Patent Application No. 2017-211621, filed on Nov. 1, 2017, and PCT Application No. PCT/JP2018/039316, filed on Oct. 23, 2018, the entire contents of which are incorporated herein by reference.

FIELD

The present invention relates to a wisdom ring puzzle in which members are coupled together and removed.

BACKGROUND

Conventionally, as typified by a Chinese ring, a disentanglement puzzle configured of a member having a shape of coupled rings and an elongated ring member has been known. Also in recent years, by taking a Chinese ring as a prototype, a disentanglement puzzle has been suggested in which a closed ring made of a rigid material and a rod made of a rigid material having one end connected to this ring are taken as one post, the disentanglement puzzle including a plurality of said posts each having the rod of any other post passing through the inner side of the ring of each post and each having the other end of the rod mutually connected to the other ends, and a closed ring-shaped string made of a soft material, in which disentanglement is performed by removing the string hung on the rod of any post (Japanese Patent No. 6112956).

However, the conventional disentanglement puzzle configured of the member having the shape of coupled rings and the elongated ring member tends to be boring because its solution is complex with repetition of simple mechanical operations. This disentanglement puzzle is not generally widespread.

SUMMARY

One object of the present invention is to provide a wisdom ring puzzle requiring a solution not in conventional disentanglement puzzles and capable of maintaining interests and eagerness for a long period of time.

A wisdom ring puzzle in one embodiment of the present invention is a wisdom ring puzzle including a first member and a second member being an annular member, the first member including a connection post, a first small ring, a second small ring, and a first large ring, and a disconnection prevention part, a first post, and a second post sequentially provided to extend from the connection post toward a substantially same direction, the first post including a first ring catching part, the second post including a second ring catching part, the first small ring swingably caught in the first post by the first ring catching part, the second small ring and the first large ring swingably caught in the second post by the second ring catching part, the disconnection prevention part passing through the first small ring and the first large ring, the first post passing through the second small ring, movable ranges of the first small ring and the first large ring defined by the disconnection prevention part, and a movable range of the second small ring defined by the first small ring.

A major axis of the first large ring may be twice as long as major axes of the first small ring and the second small ring or longer.

Also, the first member further may include a third small ring, a second large ring, and a third post, the third post may be sequentially provided to extend from the connection post on a side opposite to the first post when viewed from the second post toward a substantially same direction as that of the second post, the third post may include a third ring catching part, the third small ring and the second large ring may be swingably caught in the third post by the third ring catching part, the first post further may pass through the second large ring, the second post may pass the second large ring and the third small ring, a movable range of the second large ring may be defined by the first small ring, and a movable range of the third small ring may be defined by the second small ring.

A wisdom ring puzzle in one embodiment of the present invention is a wisdom ring puzzle including a first member and a second member, which is an annular member, the first member including a connection post, a first small ring, and a second small ring and a first chain-link ring which are mutually connected, and a disconnection prevention part, a first post, and a second post sequentially provided to extend from the connection post toward a substantially same direction, the first post including a first ring catching part, the second post including a second ring catching part, the first small ring swingably caught in the first post by the first ring catching part, the second small ring swingably caught in the second post by the second ring catching part, the disconnection prevention part passing through the first small ring and the first chain-link ring, the first post passing through the second small ring, movable ranges of the first small ring and the first chain-link ring defined by the disconnection prevention part, and a movable range of the second small ring defined by the first small ring.

A wisdom ring puzzle in one embodiment of the present invention is a wisdom ring puzzle including a first member and a second member, which is an annular member, the first member including a connection post, a first small ring, and a second small ring, a third small ring, a first chain-link ring, and a second chain-link ring which mutually connect the third small ring and the first chain-link ring, and a disconnection prevention part, a first post, a second post, and a third post sequentially provided to extend from the connection post toward a substantially same direction, the first post including a first ring catching part, the second post including a second ring catching part, the third post including a third ring catching part, the first small ring swingably caught in the first post by the first ring catching part, the second small ring swingably caught in the second post by the second ring catching part, the third small ring swingably caught in the second post by the third ring catching part, the disconnection prevention part passing through the first small ring and the first chain-link ring, the first post passing through the second small ring and the second chain-link ring, movable ranges of the first small ring and the first chain-link ring defined by the disconnection prevention part, movable ranges of the second small ring, the first chain-link ring, and the second chain-link ring defined by the first small ring, and movable ranges of the third small ring and the second chain-link ring defined by the second small ring.

A wisdom ring puzzle in one embodiment of the present invention is a wisdom ring puzzle including a first member and a second member, which is an annular member, the first member including a connection post, a first small ring, and a second small ring, a third small ring, and a first large chain-link ring which mutually connects to the third small ring, and a disconnection prevention part, a first post, a second post, and a third post sequentially provided to extend from the connection post toward a substantially same direction, the first post including a first ring catching part, the second post including a second ring catching part, the third post including a third ring catching part, the first small ring swingably caught in the first post by the first ring catching part, the second small ring swingably caught in the second post by the second ring catching part, the third small ring swingably caught in the third post by the third ring catching part, the disconnection prevention part passing through the first small ring and the first large chain-link ring, the first post passing through the second small ring and the first large chain-link ring, the second post passing through the third small ring, movable ranges of the first small ring and the first large chain-link ring defined by the disconnection prevention part, a movable range of the second small ring defined by the first small ring, and movable ranges of the third small ring and the first large chain-link ring defined by the second small ring.

A wisdom ring puzzle in one embodiment of the present invention is a wisdom ring puzzle including a first member and a second member, which is an annular member, the first member including a connection post, a small ring, and a large ring, and a disconnection prevention part, a first post, and a second post sequentially provided to extend from the connection post toward a substantially same direction, the first post including a first ring catching part, the second post including a second ring catching part, the small ring swingably caught in the first post by the first ring catching part, the large ring swingably caught in the second post by the second ring catching part, the disconnection prevention part passing through the large ring, the second post passing through the small ring, and a movable range of the large ring defined by the disconnection prevention part.

A wisdom ring puzzle in one embodiment of the present invention is a wisdom ring puzzle including a first member and a second member, which is an annular member, the first member including a connection post, a small ring, and a free ring, and a first disconnection prevention part and a second disconnection prevention part sequentially provided to extend from the connection post toward a substantially same direction, the second disconnection prevention part including a ring catching part, the small ring swingably caught in the second disconnection prevention part by the ring catching part, the first disconnection prevention part passing through the free ring and the small ring, the second disconnection prevention part passing through the free ring, a movable range of the free ring defined by the first disconnection prevention part and the second disconnection prevention part, and a movable range of the small ring defined by the first disconnection prevention part.

REFERENCE SIGNS LIST

Figure 1:
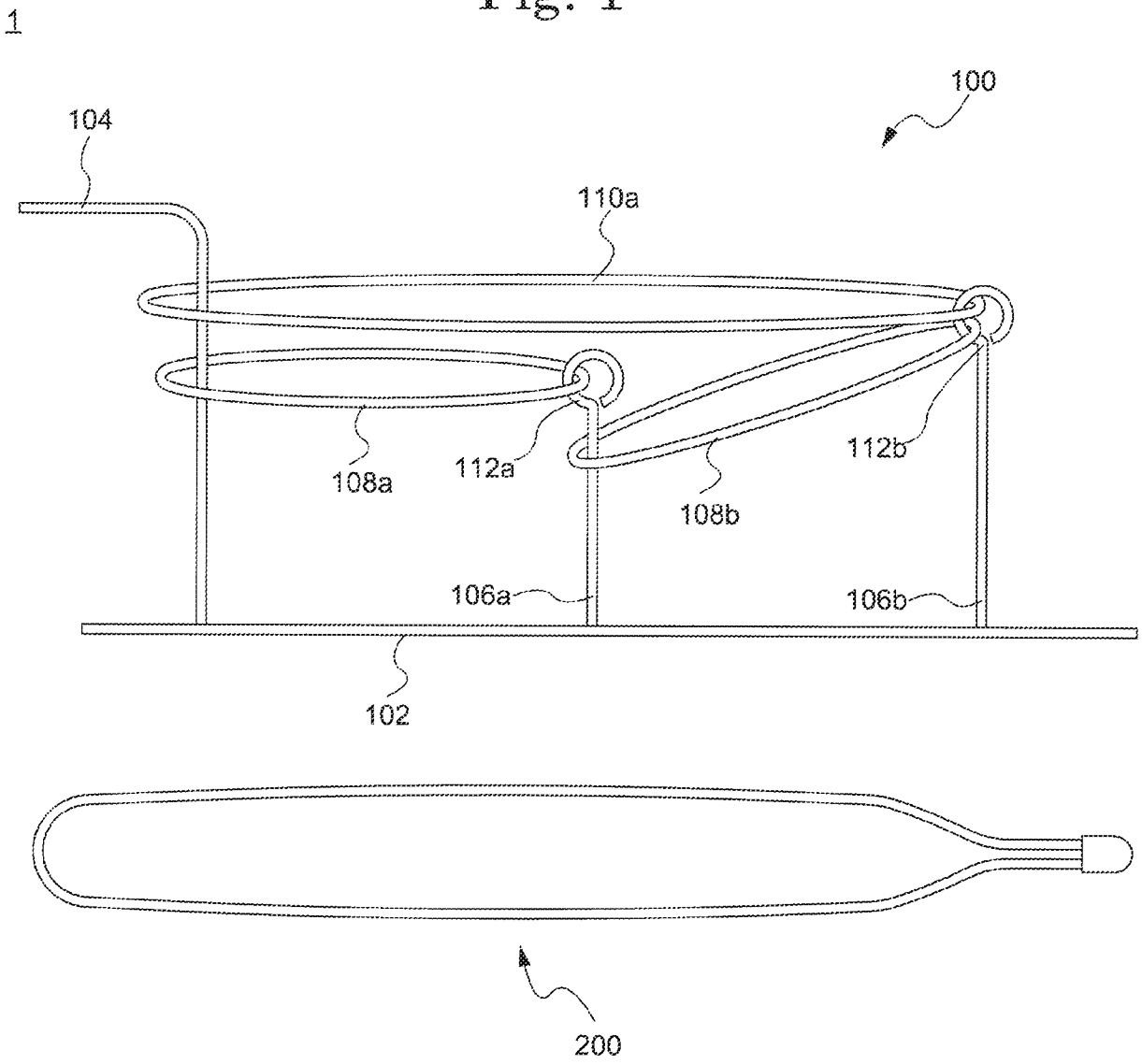
FIG. 1 is a diagram describing the structure of a wisdom ring puzzle in one embodiment of the present invention.

1 . . . wisdom ring puzzle, 100 . . . first member, 102 . . . connection post, 104 . . . disconnection prevention part, 104A . . . first disconnection prevention part, 104B . . . second disconnection prevention part, 106 . . . post, 106*a* . . . first post, 106*b* . . . second post, 106*c* . . . third post, 106*d* . . . fourth post, 108 . . . small ring, 108*a* . . . first small ring, 108*b* . . . second small ring, 108*c* . . . third small ring, 110*a* . . . first large ring, 110*b* . . . second large ring, 112*a* . . . first ring catching part, 112*b* . . . second ring catching part, 112*c* . . . third ring catching part, 114 . . . chain-link ring, 114*a* . . . first chain-link ring, 114*b* . . . second chain-link ring, 116*a* . . . first large chain-link ring, 118 . . . free ring, 200 . . . second member

EMBODIMENTS

In the following, embodiments of the present invention are each described with reference to the drawings. The disclosure is merely an example, and an appropriate change that can be easily conceived by a person skilled in the art and maintains the gist of the present invention is naturally included in the scope of the present invention. Also, in the drawings, for the purpose of further clarifying the description, the width, thickness, shape, and others of each part may be schematically represented compared with actual modes. However, this is merely an example, and is not meant to construe the present invention in a limited manner. Also, in the specification and each drawing, a component similar to one described in relation to an already-described drawing is provided with the same reference character and detailed description may be changed as appropriate.

In the specification and a drawing, "left" or "left side" means "left" or "left side" with respect to the sheet of the drawing, and "right" or "right side" means "right" or "right side" with respect to the sheet of the drawing. Also, "above" or "upper side" means "above" or "upper side" with respect to the sheet of the drawing, and "below" or "lower side" means "below" or "lower side" with respect to the sheet of the drawing. Furthermore, "front" or "front surface" means "front" or "a surface at front" with respect to the sheet of the drawing, and "depth" ("back") or "back surface" means "depth" or "a surface at the back" with respect to the sheet of the drawing. Therefore, it is evident that by freely changing a direction in which an object depicted in the drawing is viewed, the relation among above, below, left, right, and so forth is freely changed in accordance with the direction in which an object is viewed, and this does not make the present invention construed in a limited manner.

First Embodiment

[Structure of Wisdom Ring Puzzle]

FIG. 1 is a diagram describing the structure of a wisdom ring puzzle 1 in a first embodiment of the present invention. The wisdom ring puzzle 1 is, in this example, a wisdom ring puzzle formed of a first member 100 and a second member 200, which is an annular member. The material configuring the wisdom ring puzzle 1 may be a material with high rigidity such as plastic, wood, or metal, or an easily-bendable material with low rigidity such as wire, resin, or a string.

The second member 200 is an annular member. The second member 200 can take any annular form as long as it can implement a solution to the wisdom ring puzzle 1 described in the specification. The second member 200 may take, for example, an oval form or rectangular form.

The first member 100 includes a connection post 102, a disconnection prevention part 104, a first post 106*a*, a second post 106*b*, a first small ring 108*a*, a second small ring 108*b*, and a first large ring 110*a*.

The disconnection prevention part 104, the first post 106*a*, and the second post 106*b* are sequentially provided to extend toward a substantially same direction from the connection post 102. The disconnection prevention part 104, the first post 106*a*, the second post 106*b*, and the connection post 102 each have, for example, a rod shape, and the disconnection prevention part 104, the first post 106*a*, and the second post 106*b* can be said to intersect with the connection post 102. The disconnection prevention part 104, the first post 106*a*, the second post 106*b*, and the connection post 102 may be partially or entirely bent or configured of a plurality of members as long as they can implement the solution to the wisdom ring puzzle 1 described in the specification. Also, the disconnection prevention part 104, the first post 106*a*, and the second post 106*b* may be each fixed as a member integrated with the connection post 102, or may be swingably caught at a location intersecting with the connection post 102. In the specification and the claims, the "substantially same direction" includes, as a matter of course, a meaning of a "parallel direction", and also includes a direction deviated from the parallel direction as long as the solution to the wisdom ring puzzle 1 described in the specification can be implemented. Also, the lengths of the disconnection prevention part 104, the first post 106*a*, and the second post 106*b* in a longitudinal direction may be equal or varied. Furthermore, a space among the disconnection prevention part 104, the first post 106*a*, and the second post 106*b* sequentially provided to extend from the connection post 102 may be constant, or may not be constant as long as the solution to the wisdom ring puzzle 1 described in the specification can be implemented.

The disconnection prevention part 104 passes through the first small ring 108*a* and the first large ring 110*a* to define their movable ranges. That is, the disconnection prevention part 104 having a rod shape passes through the first small ring 108*a* and the first large ring 110*a*, which are annular members, and maintains the state in which the disconnection prevention part 104 passes through the first small ring 108*a* and the first large ring 110*a*. The disconnection prevention part 104 can also be said to function so that the first small ring 108*a* and the first large ring 110*a* are not removed from the disconnection prevention part 104. In one embodiment, to pass through the first small ring 108*a* and the first large ring 110*a* to define their movable ranges, the disconnection prevention part 104 depicted in FIG. 1 has a shape extending from the connection post 102, passing through the first small ring 108*a* and the first large ring 110*a*, and bent at an extended location in a direction away from the first post 106*a*. As will be described further below, since the first small ring 108*a* is caught in the first post 106*a* and the first large ring 110*a* is caught in the second post 106*b*, the first small ring 108*a* and the first large ring 110*a* cannot be removed from the disconnection prevention part 104. However, the shape the disconnection prevention part 104 can take to define the movable ranges of the first small ring 108*a* and the first large ring 110*a* is not limited to this. For example, the disconnection prevention part 104 may have a structure with an annular member swingably caught in an end part extending from the connection post 102, passing through the first small ring 108*a* and the first large ring 110*a*, and further extending therefrom, and the movable ranges of the first small ring 108*a* and the first large ring 110*a* may be defined by this annular member.

The first post 106*a* and the second post 106*b* are both provided to extend from the connection post 102, and have a first ring catching part 112*a* and a second ring catching part 112*b*, respectively. In FIG. 1, it is depicted that the first ring catching part 112*a* is included in an end part of the first post 106*a*, but this is not meant to be restrictive. The first ring catching part 112*a* may be included in the first post 106*a* at a location closer to the connection post 102 than the end part of the first post 106*a*. Also, the first ring catching part 112*a* may take any form as long as it can implement the solution to the wisdom ring puzzle 1 described in the specification, and may be in an annular form to catch the first small ring 108*a*. The above description similarly applies to the second ring catching part 112*b*.

The first small ring 108*a*, the second small ring 108*b*, and the first large ring 110*a* are all annular members. The first large ring 110*a* may be larger than the first small ring 108*a* and the second small ring 108*b*. The major axis of the first large ring 110*a* may be twice as long as the major axis of each of the first small ring 108*a* and the second small ring 108*b* or longer. "The major axis of the first large ring 110*a* is twice as long as the major axis of each of the first small ring 108*a* and the second small ring 108*b* or longer" means that when the first large ring 110*a*, the first small ring 108*a*, and the second small ring 108*b* each have an oval shape, the major axis of the first large ring 110*a* is twice as long as the major axis of each of the first small ring 108*a* and the second small ring 108*b* or longer, means that when the first large ring 110*a*, the first small ring 108*a*, and the second small ring 108*b* each have a rectangular shape, the long side of the first large ring 110*a* is twice as long as the long side of each of the first small ring 108*a* and the second small ring 108*b* or longer, and means that when the first large ring 110*a*, the first small ring 108*a*, and the second small ring 108*b* each have a perfect circular shape, the diameter of the first large ring 110*a* is twice as long as the diameter of each of the first small ring 108*a* and the second small ring 108*b* or longer.

The first small ring 108*a* is swingably caught in the first post 106*a* by the first ring catching part 112*a*. That is, the first small ring 108*a* is caught in the first post 106*a* by the first ring catching part 112*a* and cannot move away from the first ring catching part 112*a*, but can move while maintaining the state of being caught in the first post 106*a* by the first ring catching part 112*a*. However, the rod-shaped disconnection prevention part 104 passes through the first small ring 108*a*, and the first small ring 108*a* cannot be removed from this disconnection prevention part 104. That is, the first small ring 108*a* cannot move so as to make a transition from a state in which the disconnection prevention part 104 passes through the first small ring 108*a* to a state in which it does not pass therethrough. In this manner, the first small ring 108*a* can move while maintaining the state of being caught in the first post 106*a* by the first ring catching part 112*a*, but its movable range is defined by the disconnection prevention part 104.

The second small ring 108*b* is swingably caught in the second post 106*b* by the second ring catching part 112*b*. That is, the second small ring 108*b* is caught in the second post 106*b* by the second ring catching part 112*b* and cannot move away from the second ring catching part 112*b*, but can move while maintaining the state of being caught in the second post 106*b* by the second ring catching part 112*b*. However, the rod-shaped first post 106*a* passes through the second small ring 108*b*. The first post 106*a* extends from the connection post 102, passes through the second small ring 108*b*, and has the first ring catching part 112*a* at a further extended position. This first ring catching part 112*a* catches the first small ring 108*a* in the first post 106*a*, and the movable range of this first small ring 108*a* is defined by the disconnection prevention part 104. That is, the rod-shaped disconnection prevention part 104 passes through the first small ring 108*a*, and the first small ring 108*a* cannot be removed from the disconnection prevention part 104. Therefore, with the first small ring 108*a* caught in the first post 106*a*, the second small ring 108*b* cannot move so as to be removed from the first post 106*a*, that is, the second small ring 108*b* cannot move so as to make a transition from a state in which the first post 106*a* passes through the second small ring 108*b* to a state in which it does not pass therethrough. In this manner, the movable range of the second small ring 108*b* is defined by the first small ring 108*a*. Also, the first small ring 108*a* functions as a disconnection prevention part for the second small ring 108*b*.

The first large ring 110*a* is swingably caught in the second post 106*b* by the second ring catching part 112*b*. That is, the first large ring 110*a* is caught in the second post 106*b* by the second ring catching part 112*b* and cannot move away from the second ring catching part 112*b*, but can move while maintaining the state of being caught in the second post 106*b* by the second ring catching part 112*b*. However, the rod-shaped disconnection prevention part 104 passes through the first large ring 110*a*. The first large ring 110*a* cannot be removed from this disconnection prevention part 104. That is, the first large ring 110*a* cannot move so as to make a transition from a state in which the disconnection prevention part 104 passes through the first large ring 110*a* to a state in which it does not pass therethrough. In this manner, the first large ring 110*a* can move while maintaining the state of being caught in the second post 106*b* by the second ring catching part 112*b*, but its movable range is defined by the disconnection prevention part 104.

[Solution to Wisdom Ring Puzzle]

In the following, the solution of the wisdom ring puzzle 1 in the first embodiment of the present invention is described by using FIG. 1 to FIG. 7.

FIG. 1 is a diagram depicting a state in which the first member 100 and the second member 200 configuring the wisdom ring puzzle 1 are separated from each other (step S101).

Figure 2:
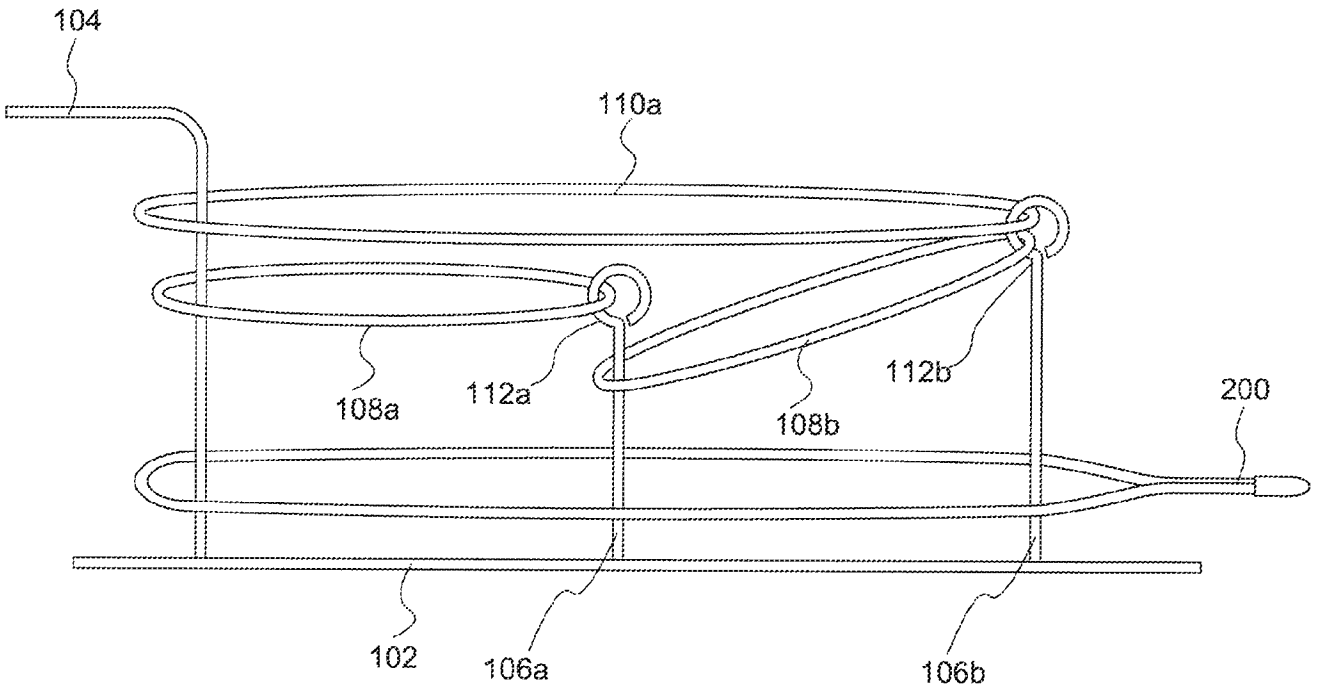
FIG. 2 is a diagram describing a solution of the wisdom ring puzzle in one embodiment of the present invention.

Next, as depicted in FIG. 2, pass the disconnection prevention part 104, the first post 106*a*, the second post 106*b*, the first small ring 108*a*, the second small ring 108*b*, and the first large ring 110*a* of the first member 100 through the ring of the second member 200 to bring about a state in which the disconnection prevention part 104, the first post 106*a*, and the second post 106*b* pass through the ring of the second member 200 (step S103). To implement the solution of the wisdom ring puzzle 1 described below, the connection post 102 may pass through the second member 200 as appropriate.

Figure 3:
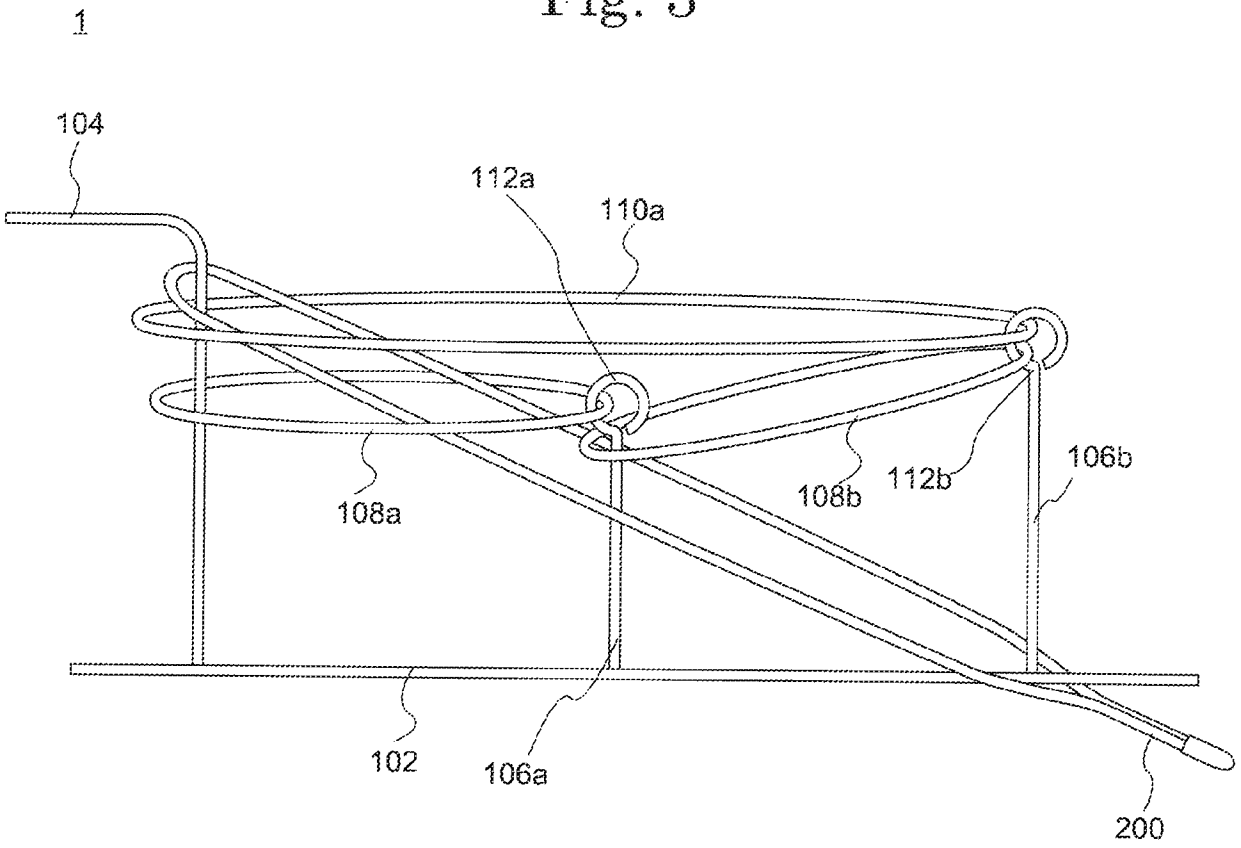
FIG. 3 is a diagram describing the solution of the wisdom ring puzzle in one embodiment of the present invention.

Next, as depicted in FIG. 3, pass the second member 200 through a space between the first small ring 108*a* and the disconnection prevention part 104 and a space between the first large ring 110*a* and the disconnection prevention part 104 positioned on a left side of the disconnection prevention part 104 (step S105). With this operation, it can also be said that the second member 200 passes through the first small ring 108*a* and the first large ring 110*a*.

Figure 4:
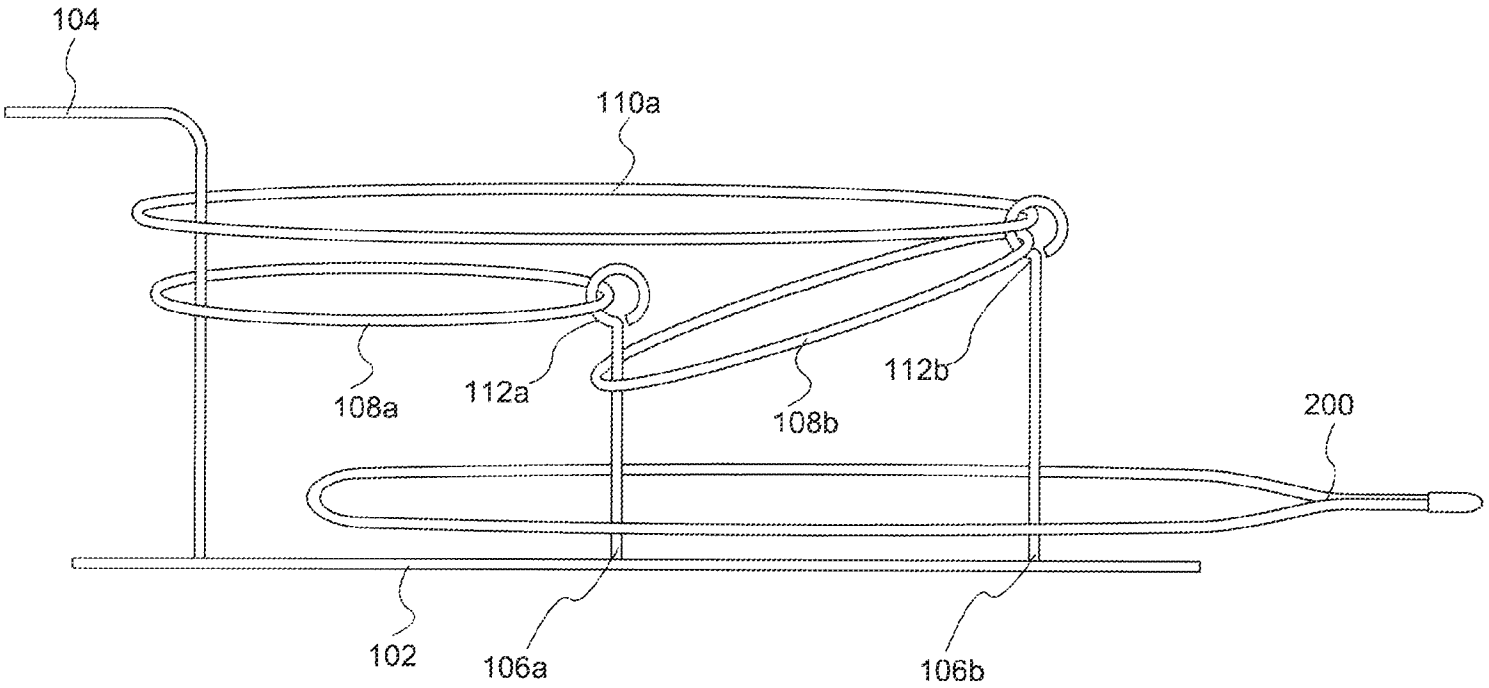
FIG. 4 is a diagram describing the solution of the wisdom ring puzzle in one embodiment of the present invention.

Next, as depicted in FIG. 4, after removing the disconnection prevention part 104 from the ring of the second member 200, remove the second member 200 from the first small ring 108*a* and the first large ring 110*a* (step S107). In other words, make a transition from a state in which the disconnection prevention part 104 passes through the ring of the second member 200 to a state in which it does not pass therethrough, and further make a transition from a state in which the second member 200 passes through the first small ring 108*a* and the first large ring 110*a* to a state in which it does not pass therethrough.

At the time when the operation in step S107 ends, as depicted in FIG. 4, the first post 106*a* and the second past 106*b* pass through the ring of the second member 200, and the disconnection prevention part 104 does not pass therethrough.

Figure 5:
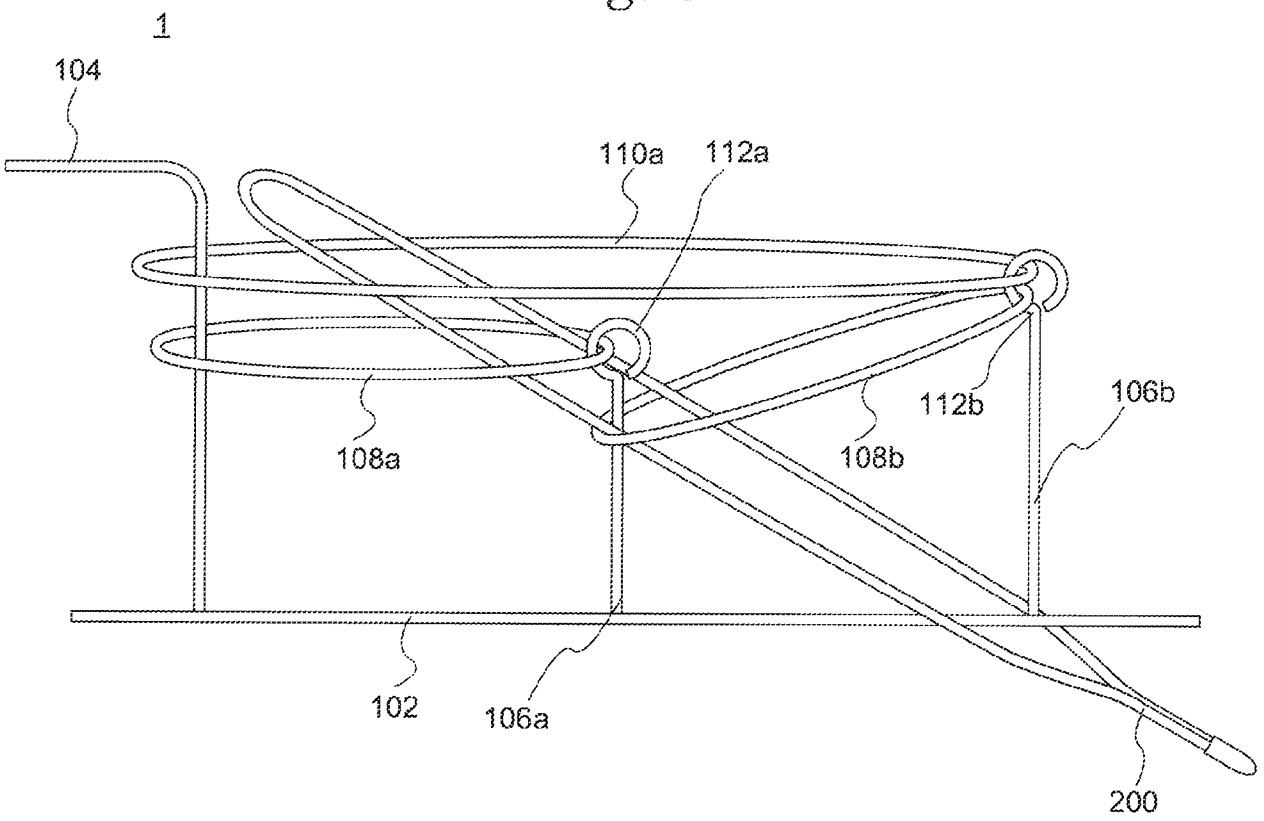
FIG. 5 is a diagram describing the solution of the wisdom ring puzzle in one embodiment of the present invention.

Next, as depicted in FIG. 5, pass the second member 200 through a space between the second small ring 108*b* and the first post 106*a* positioned on a left side of the first post 106*a*, the first small ring 108*a*, and the first large ring 110*a* (step S109). With this operation, it can also be said that the second member 200 passes through the second small ring 108*b*, the first small ring 108*a*, and the first large ring 110*a*.

Figure 6:
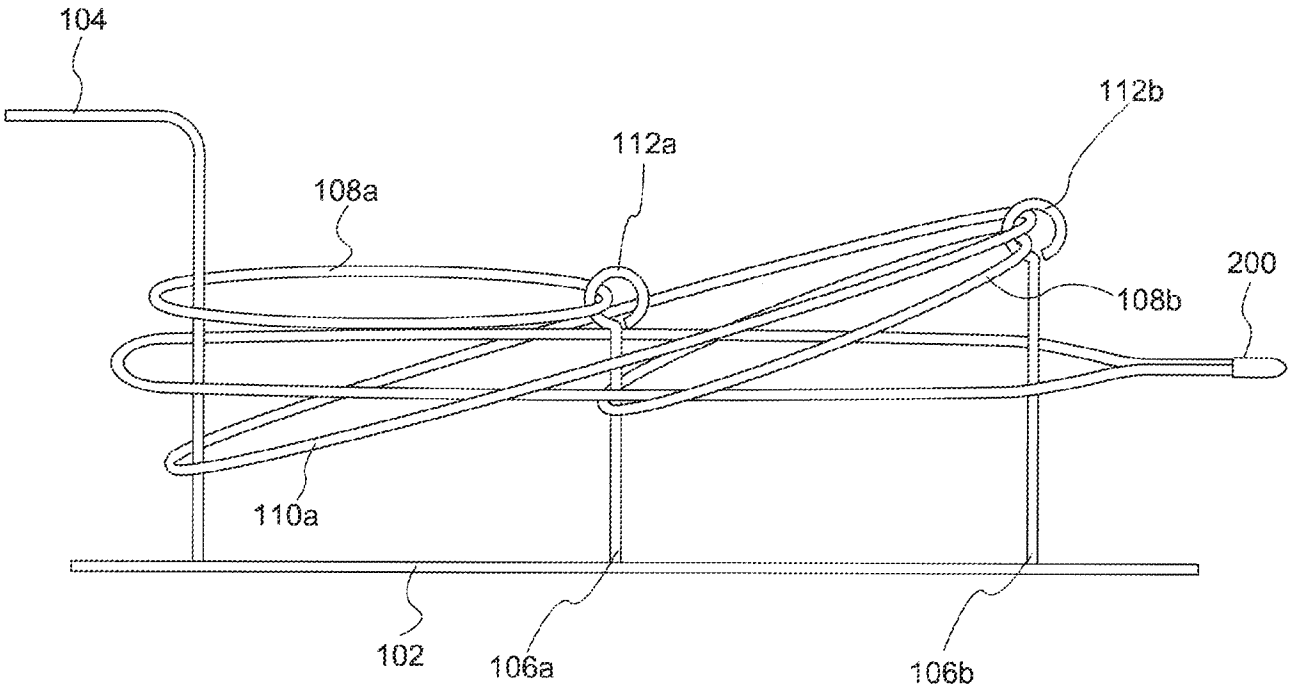
FIG. 6 is a diagram describing the solution of the wisdom ring puzzle in one embodiment of the present invention.

Next, as depicted in FIG. 6, after passing the disconnection prevention part 104 through the ring of the second member 200, remove the second member 200 in the state of passing through the first small ring 108*a* by the operation in step S109 from the first small ring 108*a* (step S111). With this operation, as depicted in FIG. 6, the state becomes such that the second member 200 does not pass through the first small ring 108*a* but passes through the second small ring 108*b* and the first large ring 110*a*.

Next, after passing the first small ring 108*a* through the ring of the second member 200, remove the disconnection prevention part 104 from the ring of the second member 200, and further remove the second member 200 from the second small ring 108*b* and the first large ring 110*a* (step S113). With this operation, as depicted in FIG. 7, the state becomes such that only the second post 106*b* passes the second member 200 and the disconnection prevention part 104 and the first post 106*a* do not pass through the second member 200.

Figure 7:
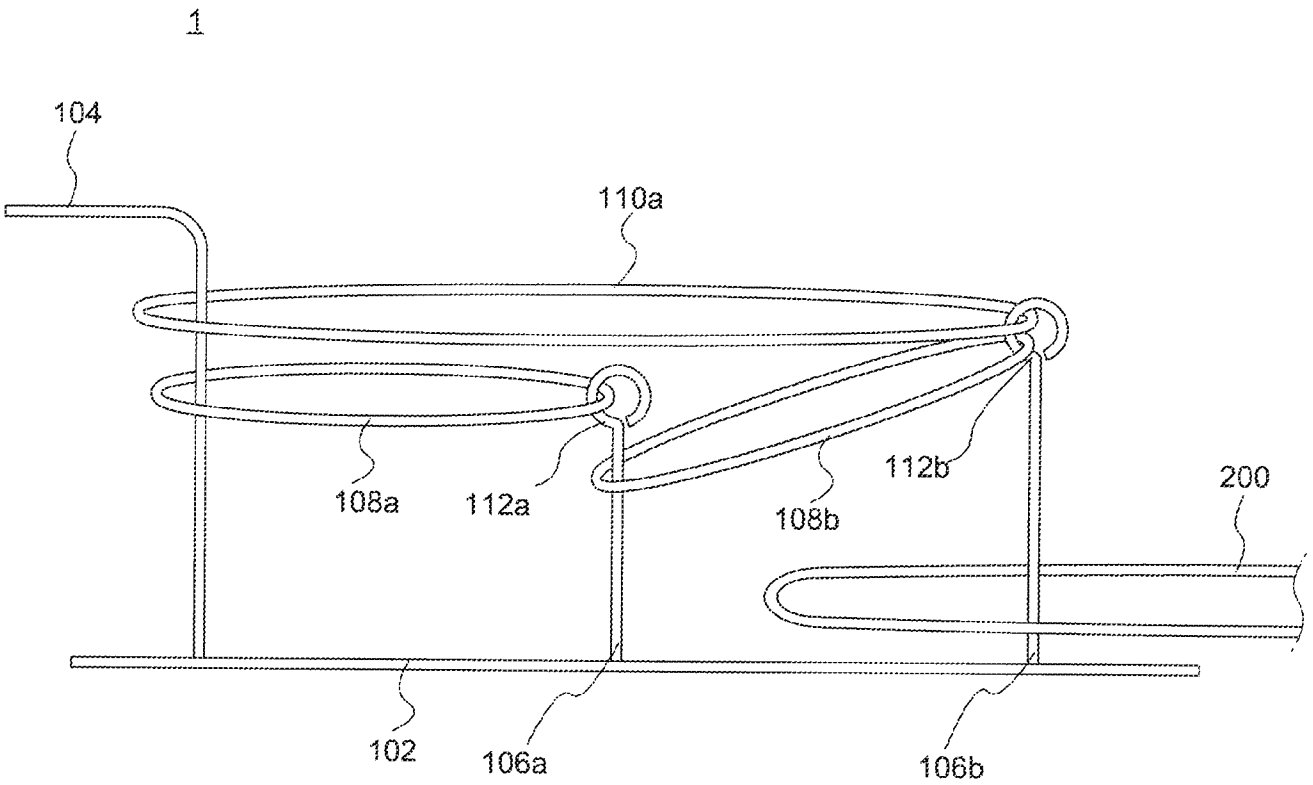
FIG. 7 is a diagram describing the solution of the wisdom ring puzzle in one embodiment of the present invention.

As described above, by performing operation as appropriate from the state in which the first member 100 and the second member 200 configuring the wisdom ring puzzle 1 are separated from each other (refer to FIG. 1), a transition can be made to a state in which the second post 106*b* of the first member 100 passes through the second member 200 but the disconnection prevention part 104 and the first post 106*a* do not pass therethrough (refer to FIG. 7). Also, by reversely performing the procedure of the solution to the wisdom ring puzzle 1 described above, a transition can also be made from the state in which the second post 106*b* of the first member 100 passes through the second member 200 but the disconnection prevention part 104 and the first post 106*a* do not pass therethrough to the state in which the first member 100 and the second member 200 are separated from each other.

In this manner, since the wisdom ring puzzle 1 in the first embodiment of the present invention has a structure not in conventional wisdom ring puzzles, a solution not in the conventional wisdom ring puzzles is required, and interests and eagerness can be maintained for a long period of time.

Second Embodiment

[Structure of Wisdom Ring Puzzle]

Figure 8:
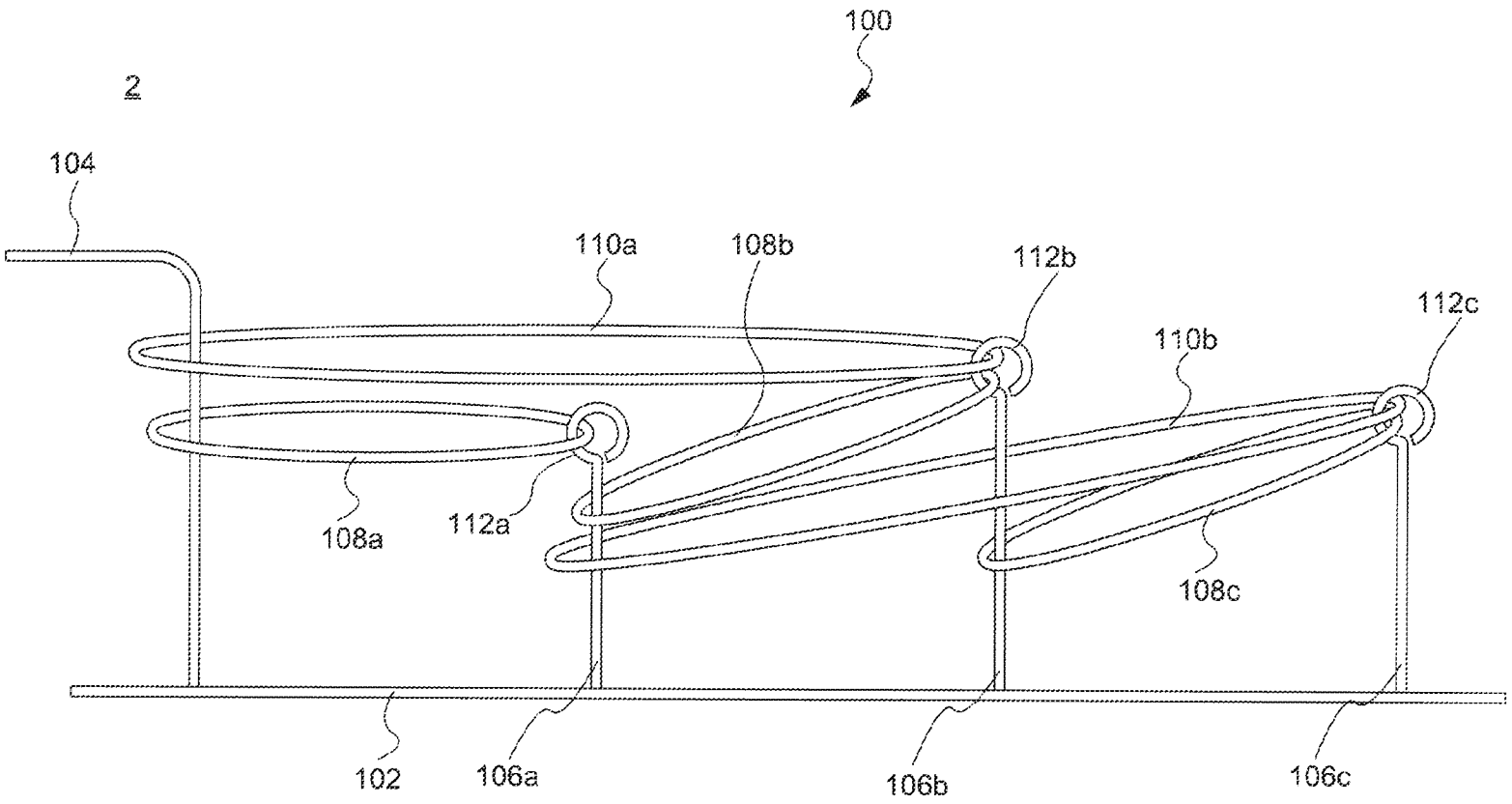
FIG. 8 is a diagram describing the structure of a wisdom ring puzzle in one embodiment of the present invention.

FIG. 8 is a diagram describing the structure of a first member 100 of a wisdom ring puzzle 2 in a second embodiment of the present invention. The first member 100 in the second embodiment of the present invention further includes, in addition to the members the first member 100 has in the first embodiment, a third small ring 108*c*, a second large ring 110*b*, and a third post 106*c*.

The third post 106*c* is sequentially provided to extend from the connection post 102 on a side opposite to the first post 106*a* when viewed from the second post 106*b* toward a substantially same direction as that of the second post 106*b*. That is, the disconnection prevention part 104, the first post 106*a*, the second post 106*b*, and the third post 106*c* are sequentially provided to extend from the connection post 102 toward a substantially same direction.

The third post 106*c* has a third ring catching part 112*c*.

The third small ring 108*c* is swingably caught in the third post 106*c* by the third ring catching part 112*c*. That is, the third small ring 108*c* is caught in the third post 106*c* by the third ring catching part 112*c* and cannot move away from the third ring catching part 112*c*, but can move while maintaining the state of being caught in the third post 106*c* by the third ring catching part 112*c*. However, the rod-shaped second post 106*b* passes through the third small ring 108*c*. The second post 106*b* extends from the connection post 102, passes through the third small ring 108*c*, and has the second ring catching part 112*b* at a further extended position. This second ring catching part 112*b* catches the second small ring 108*b* in the second post 106*b*, and the movable range of this second small ring 108*b* is defined by the first small ring 108*a*. Therefore, the third small ring 108*c* cannot move so as to be removed from the second post 106*b*, that is, the third small ring 108*c* cannot move so as to make a transition from a state in which the second post 106*b* passes through the third small ring 108*c* to a state in which it does not pass therethrough. In this manner, the movable range of the third small ring 108*c* is defined by the second small ring 108*b*.

The second large ring 110*b* is swingably caught in the third post 106*c* by the third ring catching part 112*c*. That is, the second large ring 110*b* is caught in the third post 106*c* by the third ring catching part 112*c* and cannot move away from the third ring catching part 112*c*, but can move while maintaining the state of being caught in the third post 106*c* by the third ring catching part 112*c*. However, the rod-shaped first post 106*a* and second post 106*b* pass through the second large ring 110*b*. The first post 106*a* extends from the connection post 102, passes through the second small ring 108*b* and has the first ring catching part 112*a* at a further extended position. This first ring catching part 112*a* catches the first small ring 108*a* in the first post 106*a*, and the movable range of this first small ring 108*a* is defined by the disconnection prevention part 104. Therefore, the second large ring 110*b* cannot move so as to be removed from this first post 106*a*, that is, cannot move so as to make a transition from a state in which the first post 106*a* passes through the second large ring 110*b* to a state in which it does not pass therethrough. In this manner, the movable range of the second large ring 110*b* is defined by the first small ring 108*a*.

[Solution to Wisdom Ring Puzzle 2]

In the following, the solution of the wisdom ring puzzle 2 in the second embodiment of the present invention is described.

First, from a state in which the first member 100 and the second member 200 configuring the wisdom ring puzzle 2 are separated from each other (step S201, corresponding to step S101), pass the disconnection prevention part 104, the first post 106*a*, the second post 106*b*, the third post 106*c*, the first small ring 108*a*, the second small ring 108*b*, the third small ring 108*c*, the first large ring 110*a*, and the second large ring 110*b* of the first member 100 through the ring of the second member 200 to bring about a state in which the disconnection prevention part 104, the first post 106*a*, the second post 106*b*, and the third post 106*c* pass through the ring of the second member 200 (step S203, corresponding to step S103). To implement the solution of the wisdom ring puzzle 2 described below, the connection post 102 may pass through the second member 200 as appropriate.

Next, pass the second member 200 through a space between the first small ring 108*a* and the disconnection prevention part 104 and a space between the first large ring 110*a* and the disconnection prevention part 104 positioned on a left side of the disconnection prevention part 104 (step S205, corresponding to step S105). With this operation, it can also be said that the second member 200 passes through the first small ring 108*a* and the first large ring 110*a*.

Next, after removing the disconnection prevention part 104 from the ring of the second member 200, remove the second member 200 from the first small ring 108*a* and the first large ring 110*a* (step S207, corresponding to step S107). In other words, make a transition from a state in which the disconnection prevention part 104 passes through the ring of the second member 200 to a state in which it does not pass therethrough, and further make a transition from a state in which the second member 200 passes through the first small ring 108*a* and the first large ring 110*a* to a state in which it does not pass therethrough.

At the time when the operation in step S207 ends, the first post 106*a*, the second past 106*b*, and the third post 106*c* pass through the ring of the second member 200, and the disconnection prevention part 104 does not pass therethrough.

Next, pass the second member 200 through a space between the second small ring 108*b* and the first post positioned on a left side of the first post 106*a*, a space between the second large ring 110*b* and the first post 106*a* positioned on the left side of the first post 106*a*, the first small ring 108*a*, and the first large ring 110*a* (step S209). With this operation, it can also be said that the second member 200 passes through the second large ring 110*b*, the second small ring 108*b*, the first small ring 108*a*, and the first large ring 110*a*.

Next, after passing the disconnection prevention part 104 through the ring of the second member 200, remove the second member 200 passing through the first small ring 108*a* in step S209 from the first small ring 108*a* (step S211). With this operation, the state becomes such that the second member 200 does not pass through the first small ring 108*a* but passes through the second small ring 108*b*, the first large ring 110*a*, and the second large ring 110*b*.

Next, after passing the first small ring 108*a* through the ring of the second member 200, remove the disconnection prevention part 104 from the ring of the second member 200, and further remove the second member 200 from the second small ring 108*b*, the first large ring 110*a*, and the second large ring 110*b* (step S213). With this operation, the state becomes such that only the second post 106*b* and the third post 106*c* pass through the ring of the second member 200 and the disconnection prevention part 104 and the first post 106*a* do not pass through the second member 200.

Next, pass the second member 200 through a space between the third small ring 108*c* and the second post 106*b* positioned on a left side of the second post 106*b*, the second large ring 110*b*, the second small ring 108*b*, and the first large ring 110*a* (step S215). Furthermore, pass the disconnection prevention part 104 and the first small ring 108*a* through the ring of the second member 200 (step S217).

Next, pass the second member 200 through a space between the first small ring 108*a* and the disconnection prevention part 104 positioned on a left side of the disconnection prevention part 104 (step S219), further remove the disconnection prevention part 104 from the ring of the second member 200, and remove the second member 200 from the first small ring 108*a*, the second small ring 108*b*, the first large ring 110*a*, and the second large ring 110*b* (step S221). With this operation, the state becomes such that the second member 200 passes through the third small ring 108*c* and the first post 106*a*, the second post 106*b*, and the third post 106*c* pass through the second member 200.

Next, pass the second member 200 through the first small ring 108*a*, the first large ring 110*a*, and the second large ring 110*b* (step S223). Here, do not pass it through the second small ring 108*b*. With this operation, the state becomes such that the second member 200 passes through the third small ring 108*c*, the second large ring 110*b*, the first large ring 110*a*, and the first small ring 108*a*.

Next, pass the disconnection prevention part 104 through the second member 200 (step S225) and remove the second member 200 from the first small ring 108*a* and the first large ring 110*a* (step S227).

Next, pass the first small ring 108*a*, the second small ring 108*b*, and the first large ring 110*a* through the second member 200 (step S229), and remove the disconnection prevention part 104, the first post 106*a*, and the second post 106*b* from the second member 200 (step S231). Then, when the second member 200 is moved and the second member 200 is removed from the second large ring 110*b* and the third small ring 108*c*, the state becomes such that only the third post 106*c* passes through the second member 200 and the disconnection prevention part 104, the first post 106*a*, and the second post 106*b* do not pass through the second member 200 (step S233).

As described above, the wisdom ring puzzle 2 according to the second embodiment, by performing operation as appropriate from the state in which the first member 100 and the second member 200 are separated from each other (refer to FIG. 8), a transition can be made to a state in which the third post 106*c* of the first member 100 passes through the second member 200 but the disconnection prevention part 104, the first post 106*a*, and the second post 106*b* do not pass therethrough. It is also possible, as a matter of course, to perform its reverse operation.

In this manner, as with the first embodiment, since the wisdom ring puzzle 2 in the second embodiment of the present invention has a structure not in conventional wisdom ring puzzles, a solution not in the conventional wisdom ring puzzles is required, and interests and eagerness can be maintained for a long period of time.

Third Embodiment

[Structure of Wisdom Ring Puzzle 3]

Figure 9:
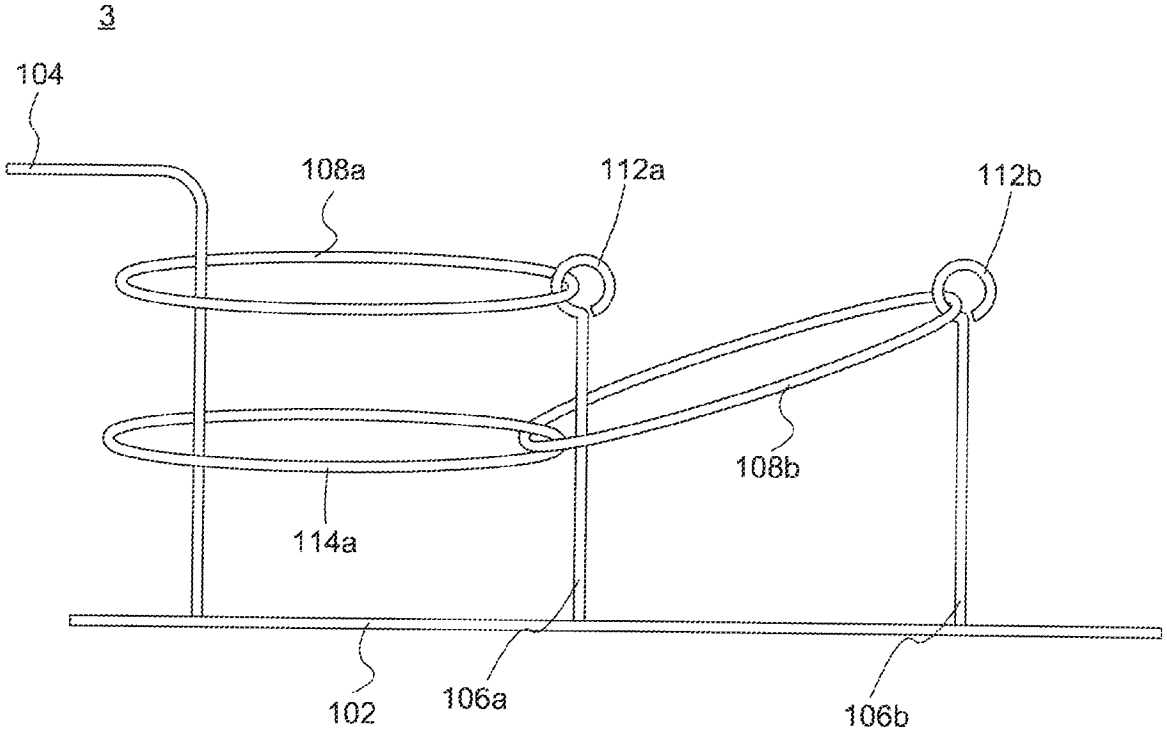
FIG. 9 is a diagram describing the structure of a wisdom ring puzzle in one embodiment of the present invention.

FIG. 9 is a diagram describing the structure of a first member 100 of a wisdom ring puzzle 3 in a third embodiment of the present invention. The wisdom ring puzzle 3 in the third embodiment includes the first member 100 and the second member 200. The first member 100 includes the connection post 102, the disconnection prevention part 104, the first post 106*a*, the second post 106*b*, the first small ring 108*a*, the second small ring 108*b*, and a first chain-link ring 114*a*. Portions where the description of the structures of the wisdom ring puzzles in the first embodiment and the second embodiment is commonly applied are omitted.

As with the first small ring 108*a* and the second small ring 108*b*, the first chain-link ring 114*a* is an annular member. Also, the disconnection prevention part 104 passes through the first chain-link ring 114*a*, which also mutually connects to the second small ring 108*b* through which the first post 106*a* passes. Therefore, as with the first small ring 108*a*, the first chain-link ring 114*a* cannot be removed from the disconnection prevention part 104. That is, the first chain-link ring 114*a* cannot move so as to make a transition from a state in which the disconnection prevention part 104 passes through the first chain-link ring 114*a* to a state in which it does not pass therethrough. In this manner, the movable range of the first chain-link ring 114*a* is defined by the disconnection prevention part 104.

[Solution to Wisdom Ring Puzzle]

In the following, the solution of the wisdom ring puzzle 3 in the third embodiment of the present invention is described by using FIG. 9 to FIG. 14.

FIG. 9 is a diagram depicting a state in which the first member 100 and the second member 200 configuring the wisdom ring puzzle 3 are separated from each other (step S301).

First, pass the disconnection prevention part 104, the first post 106*a*, the second post 106*b*, the first small ring 108*a*, the second small ring 108*b*, and the first chain-link ring 114*a* of the first member 100 through the ring of the second member 200 to bring about a state in which the disconnection prevention part 104, the first post 106*a*, and the second post 106*b* pass through the ring of the second member 200.

Figure 10:
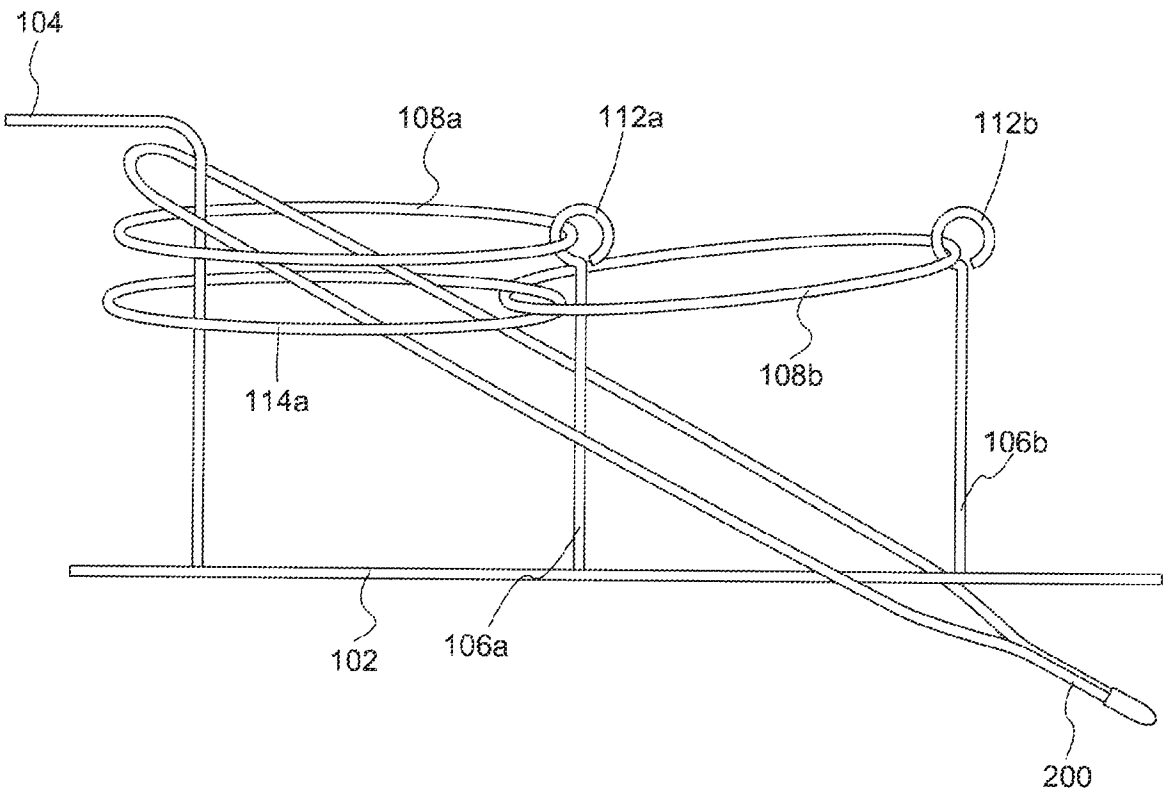
FIG. 10 is a diagram describing a solution of the wisdom ring puzzle in one embodiment of the present invention.

Next, as depicted in FIG. 10, pass the second member 200 through a space between the first small ring 108*a* and the disconnection prevention part 104 positioned on a left side of the disconnection prevention part 104 and a space between the first chain-link ring 114*a* and the disconnection prevention part 104 positioned on the left side of the disconnection prevention part 104 (step S303). To implement the solution of the wisdom ring puzzle 3 described below, the connection post 102 may pass through the second member 200 as appropriate.

Figure 11:
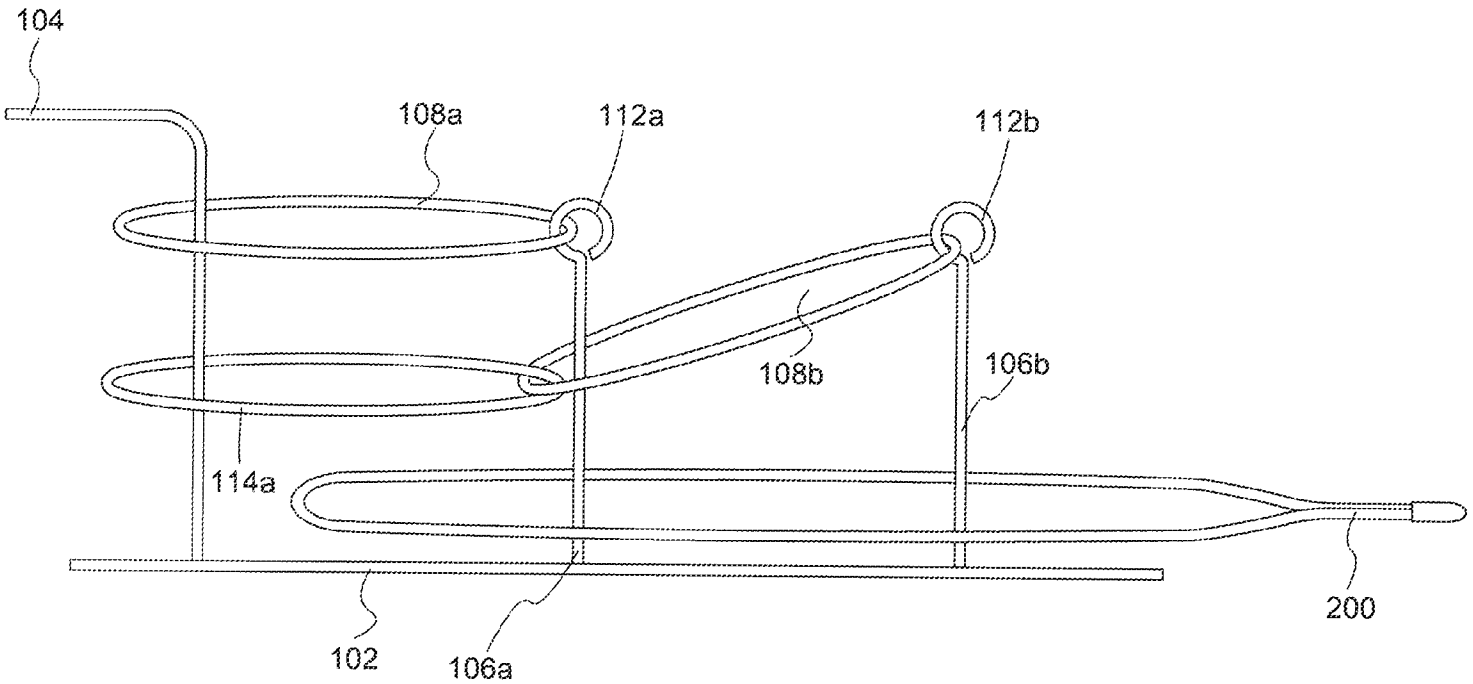
FIG. 11 is a diagram describing the solution of the wisdom ring puzzle in one embodiment of the present invention.

Next, as depicted in FIG. 11, after removing the disconnection prevention part 104 from the ring of the second member 200, remove the second member 200 from the first chain-link ring 114*a* and the first small ring 108*a* (step S305). In other words, make a transition from a state in which the disconnection prevention part 104 passes through the ring of the second member 200 to a state in which it does not pass therethrough, and further make a transition from a state in which the second member 200 passes through the first chain-link ring 114*a* and the first small ring 108*a* to a state in which it does not pass therethrough.

At the time when the operation in step S305 ends, as depicted in FIG. 11, the first post 106*a* and the second post 106*b* pass through the ring of the second member 200 and the disconnection prevention part 104 does not pass therethrough.

Figure 12:
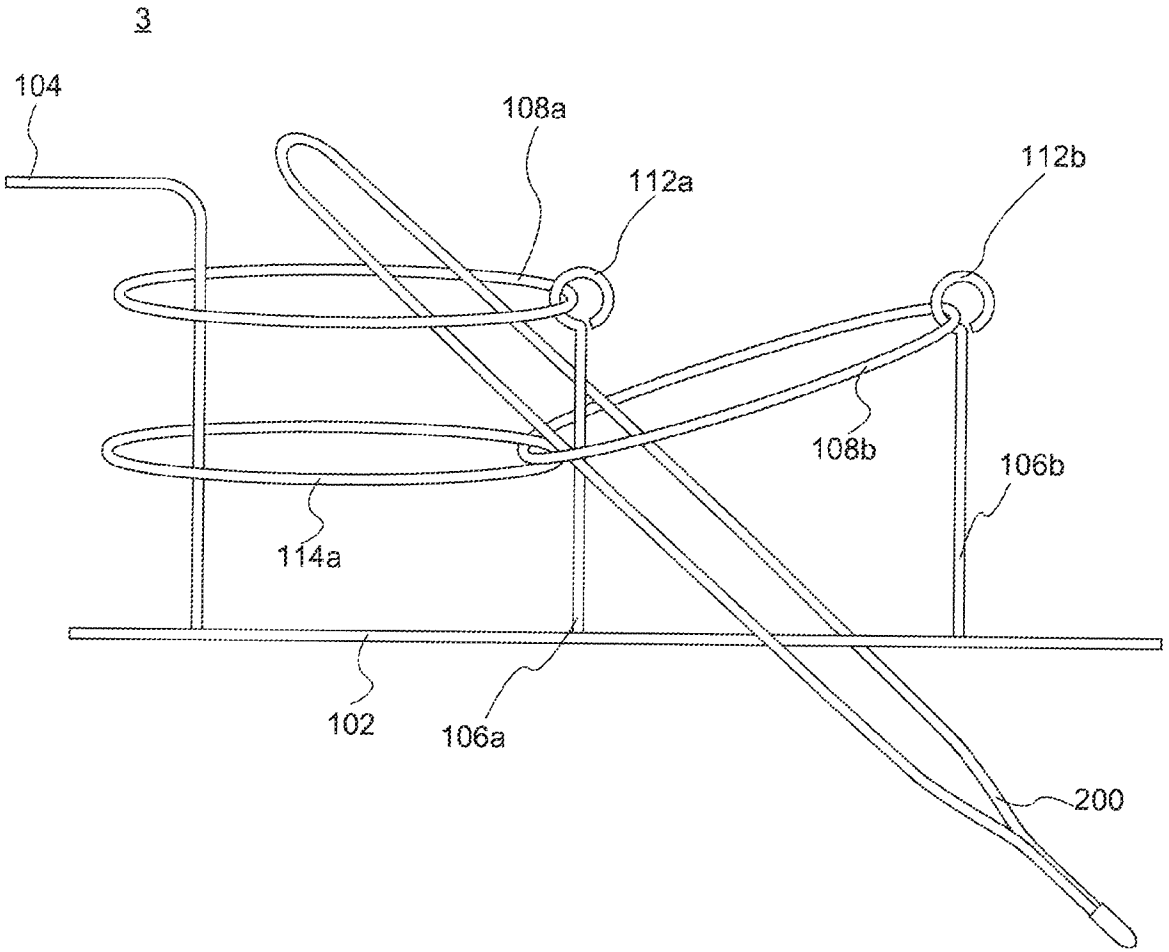
FIG. 12 is a diagram describing the solution of the wisdom ring puzzle in one embodiment of the present invention.

Next, as depicted in FIG. 12, pass the second member 200 through a space between the second small ring 108*b* and the first post 106*a* positioned on a left side of the first post 106*a* and the first small ring 108*a* (step S307). Here, do not pass the second member 200 through the first chain-link ring 114*a*. With this operation, it can also be said that the second member 200 passes through the first small ring 108*a* and the second small ring 108*b*.

Figure 13:
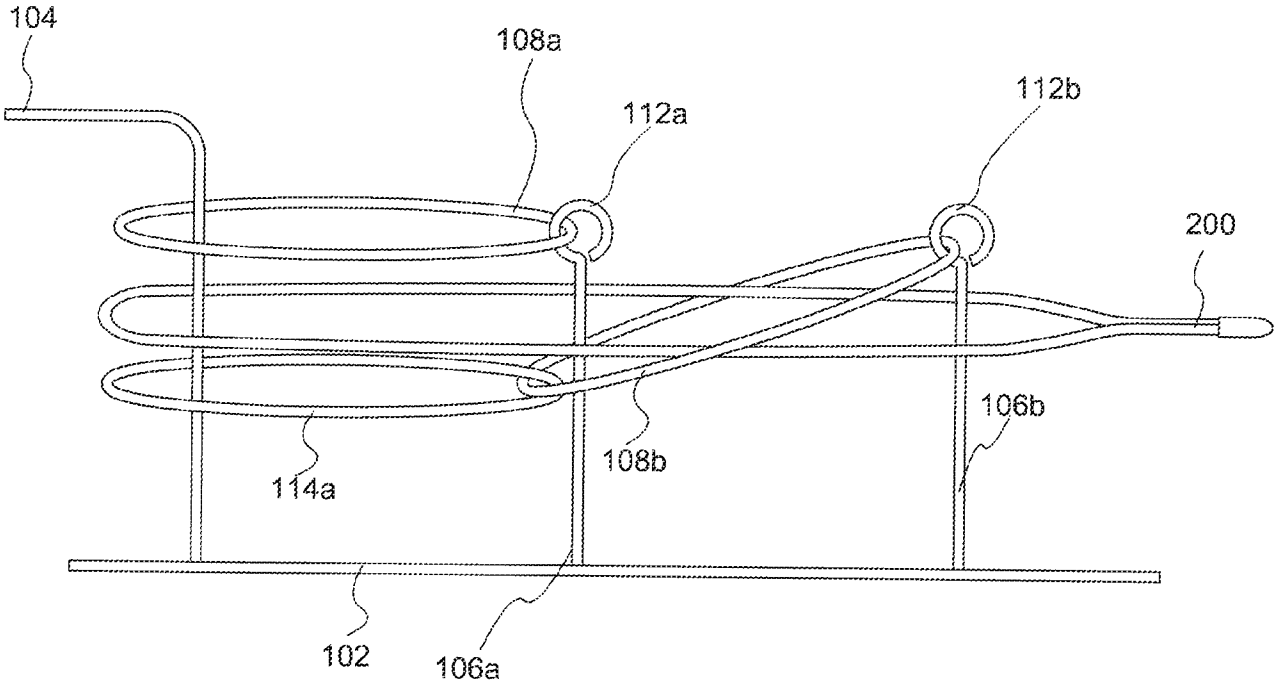
FIG. 13 is a diagram describing the solution of the wisdom ring puzzle in one embodiment of the present invention.

Next, as depicted in FIG. 13, after passing the disconnection prevention part 104 through the ring of the second member 200, remove the second member 200 in the state of passing through the first small ring 108*a* by the operation in step S307 from the first small ring 108*a* (step S309). With this operation, as depicted in FIG. 13, the state becomes such that the second member 200 does not pass through the first small ring 108*a* but passes through the second small ring 108*b*.

Figure 14:
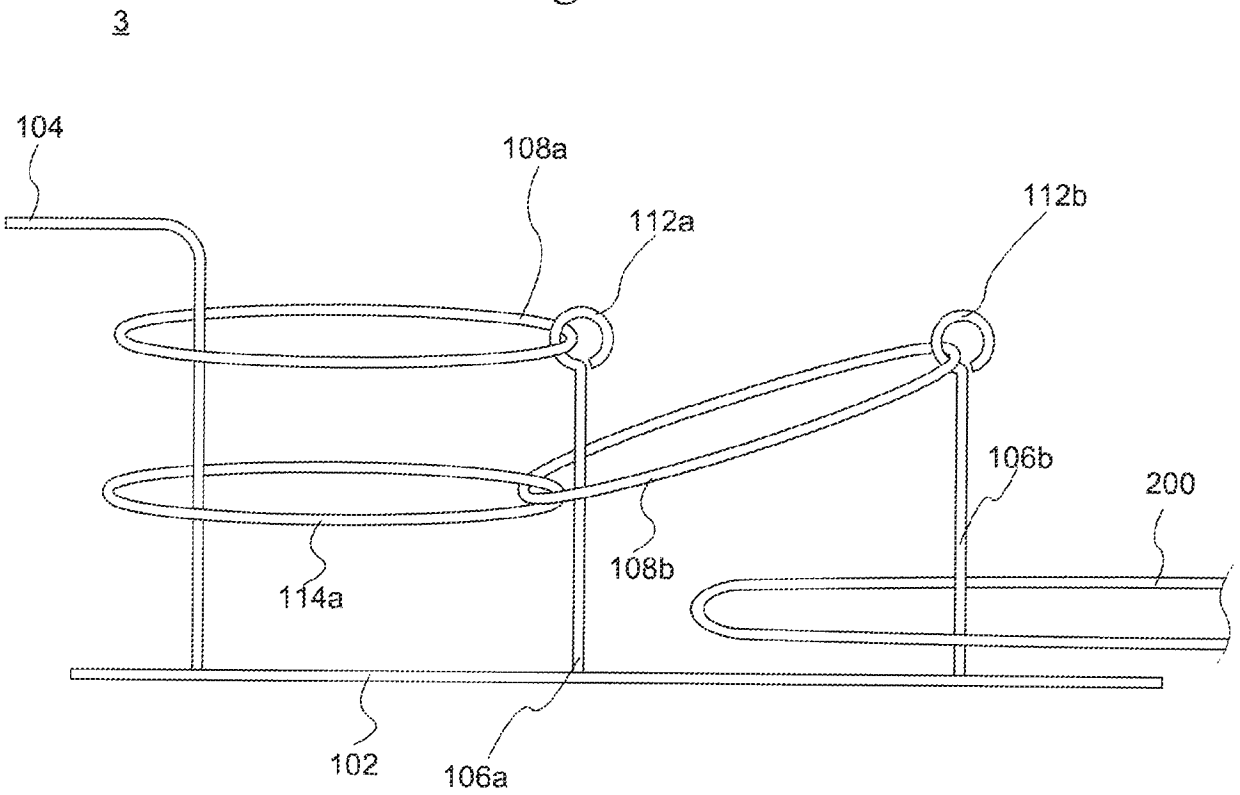
FIG. 14 is a diagram describing the solution of the wisdom ring puzzle in one embodiment of the present invention.

Next, as depicted in FIG. 14, after passing the first small ring 108*a* through the ring of the second member 200, remove the disconnection prevention part 104 from the ring of the second member 200, and further remove the second member 200 from the second small ring 108*b* (step S311). With this operation, as in FIG. 14, the state becomes such that only the second post 106*b* passes through the second member 200 and the disconnection prevention part 104 and the first post 106*a* do not pass through the second member 200.

As described above, in the wisdom ring puzzle 3 according to the third embodiment, by performing operation as appropriate from the state in which the first member 100 and the second member 200 are separated from each other (refer to FIG. 9), a transition can be made to a state in which the third post 106*c* of the first member 100 passes through the second member 200 but the disconnection prevention part 104, the first post 106*a*, and the second post 106*b* do not pass therethrough (refer to FIG. 14). It is also possible, as a matter of course, to perform its reverse operation.

In this manner, as with the first and second embodiments, since the wisdom ring puzzle 3 in the third embodiment of the present invention has a structure not in conventional wisdom ring puzzles, a solution not in the conventional wisdom ring puzzles is required, and interests and eagerness can be maintained for a long period of time.

Fourth Embodiment

[Structure of Wisdom Ring Puzzle 4]

Figure 15:
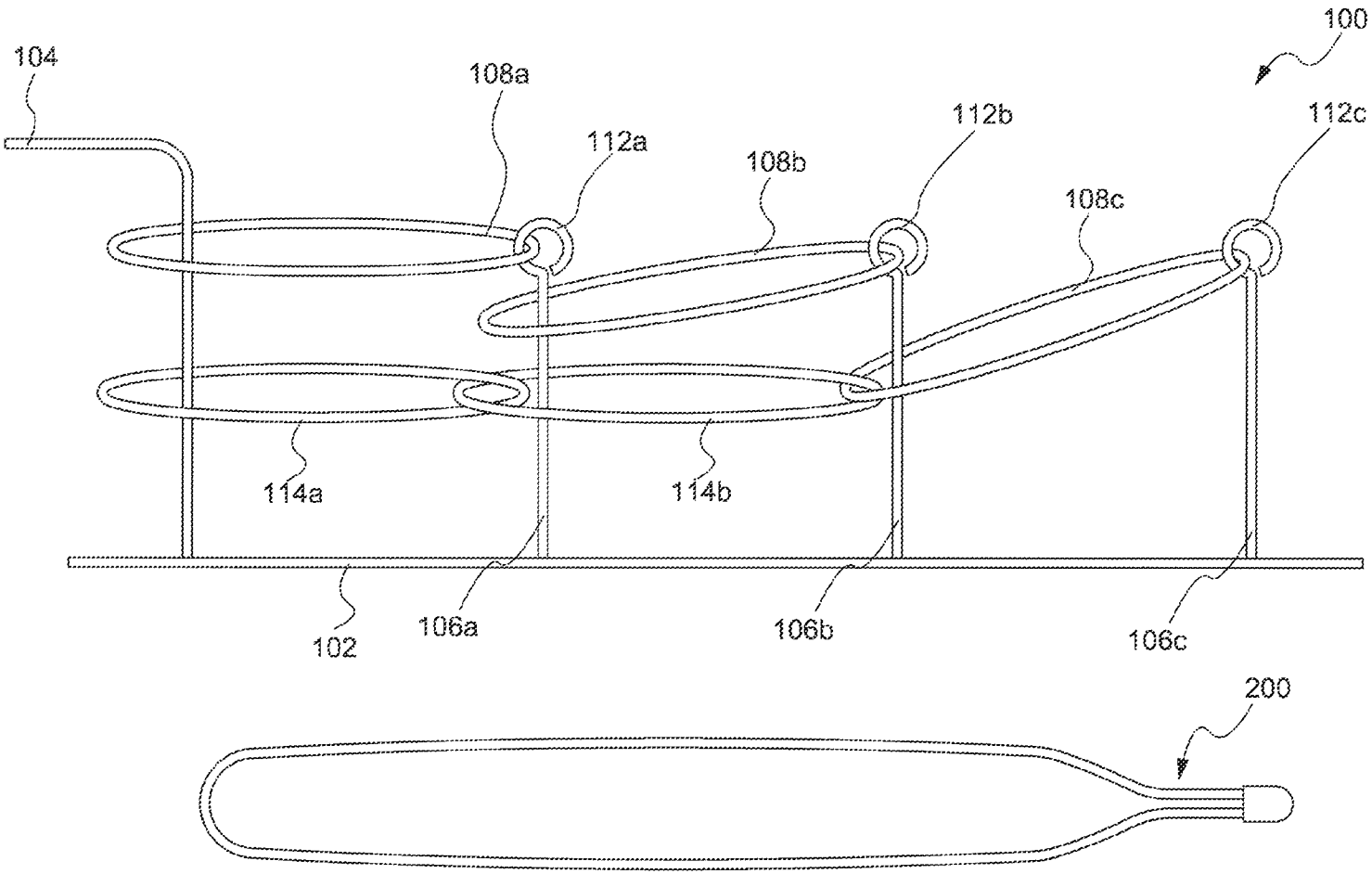
FIG. 15 is a diagram describing the structure of a wisdom ring puzzle in one embodiment of the present invention.

FIG. 15 is a diagram describing the structure of a first member 100 of a wisdom ring puzzle 4 in a fourth embodiment of the present invention. In the wisdom ring puzzle 4 in the fourth embodiment, the first member 100 and the second member 200 are included. The first member 100 includes the connection post 102, the disconnection prevention part 104, the first post 106*a*, the second post 106*b*, the third post 106*c*, the first small ring 108*a*, the second small ring 108*b*, the third small ring 108*c*, the first chain-link ring 114*a*, and a second chain-link ring 114*b*. Portions where the description of the structures of the wisdom ring puzzles in the first to third embodiments is commonly applied are omitted.

As with the first small ring 108*a*, the second small ring 108*b*, and the third small ring 108*c*, the first chain-link ring 114*a* and the second chain-link ring 114*b* are annular members. The second chain-link ring 114*b* mutually connects the third small ring 108*c* and the first chain-link ring 114*a*. That is, the second chain-link ring 114*b* mutually connects to the third small ring 108*c* and also mutually connects to the first chain-link ring 114*a*.

The disconnection prevention part 104 is provided to extend from the connection post 102, passes through the first chain-link ring 114*a*, and further extends to pass through the first small ring 108*a*. As with the first to third embodiments, the first small ring 108*a* has its movable range defined by the disconnection prevention part 104, and cannot be removed from the disconnection prevention part 104. Thus, the first chain-link ring 114*a* also cannot be removed from the disconnection prevention part 104, either. That is, the movable range of the first chain-link ring 114*a* is defined by the disconnection prevention part 104.

The first post 106*a* is provided to extend from the connection post 102, passes through the second chain-link ring 114*b*, further extends to pass through the second small ring 108*b*, and has the first ring catching part 112*a* at a further extended position for catching the first small ring 108*a*. As with the first embodiment to the third embodiment, the first small ring 108*a* has its movable range defined by the disconnection prevention part 104, and cannot be removed from the disconnection prevention part 104. Also, the second small ring 108*b* has its movable range defined by the first small ring 108*a*, and cannot be removed from the first post 106*a*. Therefore, the second chain-link ring 114*b* cannot be removed from the first post 106*a*. That is, the second chain-link ring 114*b* has the movable range defined by the first small ring 108*a* and defined also by the second small ring 108*b*.

As with the second embodiment, the movable range of the third small ring 108*c* is defined by the second small ring 108*b*.

[Solution to Wisdom Ring Puzzle 4]

In the following, the solution of the wisdom ring puzzle 4 in the fourth embodiment of the present invention is described.

First, as depicted in FIG. 15, from a state in which the first member 100 and the second member 200 configuring the wisdom ring puzzle 4 are separated from each other (step S401, corresponding to step S301), pass the disconnection prevention part 104, the first post 106*a*, the second post 106*b*, the third post 106*c*, the first small ring 108*a*, the second small ring 108*b*, the third small ring 108*c*, the first chain-link ring 114*a*, and the second chain-link ring 114*b* of the first member 100 through the ring of the second member 200 to bring about a state in which the disconnection prevention part 104, the first post 106*a*, the second post 106*b*, and the third post 106*c* pass through the ring of the second member 200. Next, pass the second member 200 through a space between the first small ring 108*a* and the disconnection prevention part 104 positioned on a left side of the disconnection prevention part 104 and a space between the first chain-link ring 114*a* and the disconnection prevention part 104 positioned on the left side of the disconnection prevention part 104 (step S403, corresponding to step S303). To implement the solution of the wisdom ring puzzle 4 described below, the connection post 102 may pass through the second member 200 as appropriate.

Next, after removing the disconnection prevention part 104 from the ring of the second member 200, remove the second member 200 from the first chain-link ring 114*a* and the first small ring 108*a* (step S405, corresponding to step S305). In other words, make a transition from a state in which the disconnection prevention part 104 passes through the ring of the second member 200 to a state in which it does not pass therethrough, and further make a transition from a state in which the second member 200 passes through the first chain-link ring 114*a* and the first small ring 108*a* to a state in which it does not pass therethrough.

At the time when the operation in step S405 ends, the first post 106*a*, the second post 106*b*, and the third post 106*c* pass through the ring of the second member 200 and the disconnection prevention part 104 does not pass therethrough.

Next, pass the second member 200 through a space between the second chain-link ring 114*b* and the first post 106*a* positioned on a left side of the first post 106*a*, a space between the second small ring 108*b* and the first post 106*a* positioned on the left side of the first post 106*a*, and the first small ring 108*a* (step S407, corresponding to step S307). Here, do not pass the second member 200 through the first chain-link ring 114*a*. With this operation, it can also be said that the second member 200 passes through the second chain-link ring 114*b*, the second small ring 108*b*, and the first small ring 108*a*.

Next, after passing the disconnection prevention part 104 through the ring of the second member 200, remove the second member 200 in the state of passing through the first small ring 108*a* by the operation in step S407 from the first small ring 108*a* (step S409, corresponding to step S309). With this operation, the state becomes such that the second member 200 does not pass through the first small ring 108*a* but passes through the second chain-link ring 114*b* and the second small ring 108*b*.

Next, after passing the first small ring 108*a* through the ring of the second member 200, remove the disconnection prevention part 104 from the ring of the second member 200, and further remove the second member 200 from the second small ring 108*b* and the second chain-link ring 114*b* (step S411). With this operation, the state becomes such that the second post 106*b* and the third post 106*c* pass through the second member 200 and the disconnection prevention part 104 and the first post 106*a* do not pass through the second member 200.

Next, after passing the second member 200 through a space between the third small ring 108*c* and the second post 106*b* positioned on a left side of the second post 106*b* and the second small ring 108*b*, pass the disconnection prevention part 104 and the first small ring 108*a* through the ring of the second member 200 (step S413).

Next, after passing the second member 200 through a space between the first small ring 108*a* and the disconnection prevention part 104 positioned on a left side of the disconnection prevention part 104, remove the disconnection prevention part 104 from the ring of the second member 200, and remove the second member 200 from the first small ring 108*a* and the second small ring 108*b* (step S415). With this operation, the state becomes such that the second member 200 passes through the third small ring 108*c* and the first post 106*a*, the second post 106*b*, and the third post 106*c* pass through the second member 200.

Next, pass the second member 200 through the first small ring 108*a* (step S417). Here, do not pass it through the second small ring 108*b*.

Next, after passing the disconnection prevention part 104 through the second member 200, remove the second member 200 from the first small ring 108*a* (step S419).

Next, after passing the first small ring 108*a* and the second small ring 108*b* through the second member 200, remove the disconnection prevention part 104, the first post 106*a*, and the second post 106*b* from the second member 200, and remove the second member 200 from the third small ring 108*c* (step S421). With this operation, the state becomes such that only the third post 106*c* passes through the second member 200 and the disconnection prevention part 104, the first post 106*a*, and the second post 106*b* do not pass through the second member 200.

As described above, in the wisdom ring puzzle 4 according to the fourth embodiment, by performing operation as appropriate from the state in which the first member 100 and the second member 200 are separated from each other (refer to FIG. 15), a transition can be made to a state in which the third post 106*c* of the first member 100 passes through the second member 200 but the disconnection prevention part 104, the first post 106*a*, and the second post 106*b* do not pass therethrough. It is also possible, as a matter of course, to perform its reverse operation.

In this manner, as with the first to third embodiments, since the wisdom ring puzzle 4 in the fourth embodiment of the present invention has a structure not in conventional wisdom ring puzzles, a solution not in the conventional wisdom ring puzzles is required, and interests and eagerness can be maintained for a long period of time.

Fifth Embodiment

[Structure of Wisdom Ring Puzzle 5]

Figure 16:
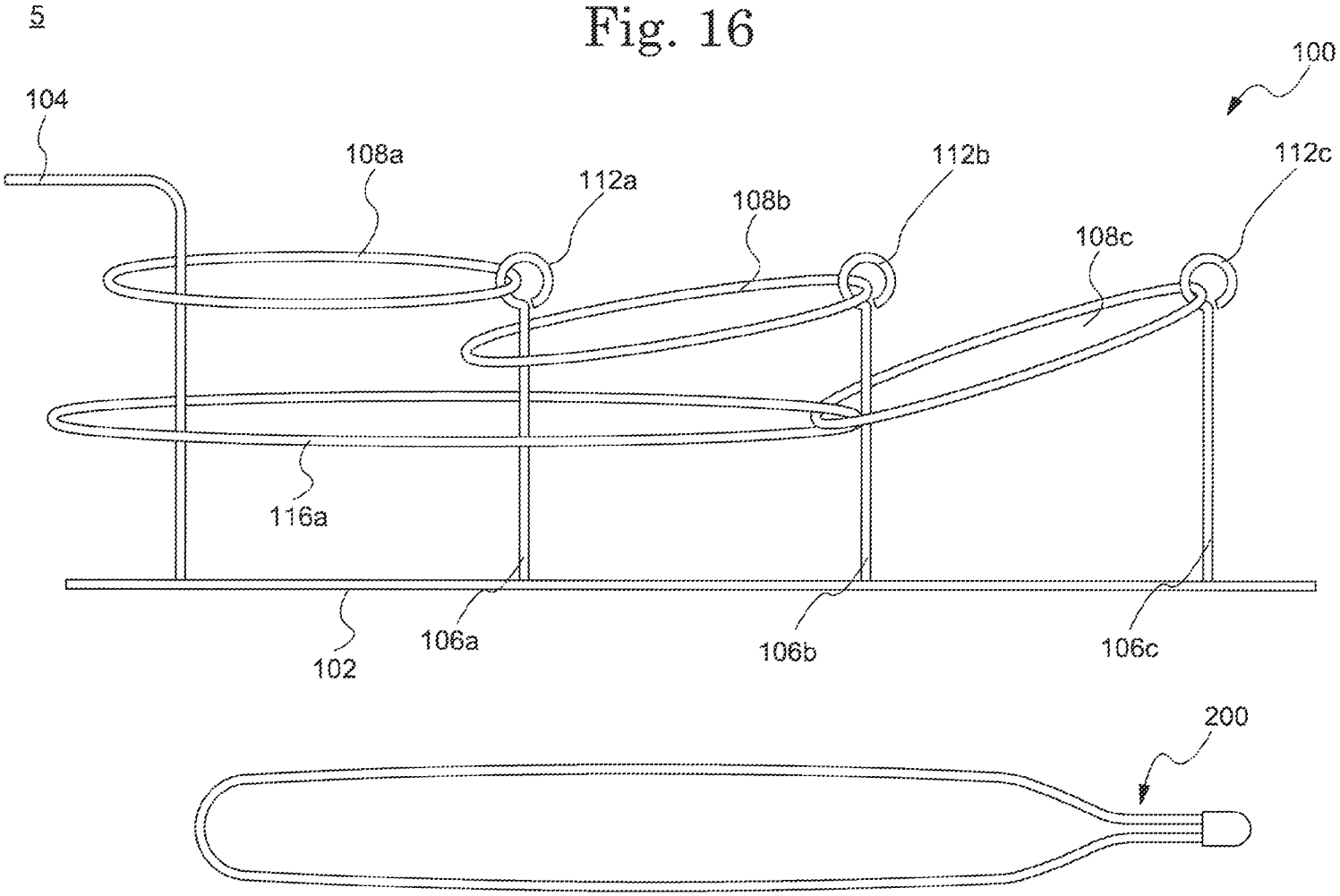
FIG. 16 is a diagram describing the structure of a wisdom ring puzzle in one embodiment of the present invention.

FIG. 16 is a diagram describing the structure of a first member 100 of a wisdom ring puzzle 5 in a fifth embodiment of the present invention. In the wisdom ring puzzle 5 in the fifth embodiment, the first member 100 and the second member 200 are included. The first member 100 includes the connection post 102, the disconnection prevention part 104, the first post 106*a*, the second post 106*b*, the third post 106*c*, the first small ring 108*a*, the second small ring 108*b*, the third small ring 108*c*, and a first large chain-link ring 116*a*. Portions where the description of the structures of the wisdom ring puzzles in the first to forth embodiments is commonly applied are omitted.

As with the first large ring 110*a* in the first embodiment, the first large chain-link ring 116*a* is an annular member, and may be larger than the first small ring 108*a* and the second small ring 108*b*. The first large chain-link ring 116*a* mutually connects to the third small ring 108*c*. The major axis of the first large chain-link ring 116*a* may be twice as long as the major axis of each of the first small ring 108*a* and the second small ring 108*b* or longer.

Through the first large chain-link ring 116*a*, the disconnection prevention part 104 and the first post 106 pass.

The disconnection prevention part 104 passes through the first large chain-link ring 116*a* and the first small ring 108*a* to maintain a state in which the disconnection prevention part 104 passes through the first large chain-link ring 116*a* and the first small ring 108*a*. It can also be said that the disconnection prevention part 104 functions so that the first small ring 108*a* and the first large ring 110*a* are not removed from the disconnection prevention part 104. Therefore, it can be said that the movable range of the first large chain-link ring 116*a* is defined by the disconnection prevention part 104.

Also, the first post 106*a* passes through the first large chain-link ring 116*a* and further extends to pass through the second small ring 108*b*. This second small ring 108*b* is caught in the second post 106*b*, and has its movable range defined by the first small ring 108*a*. That is, the second small ring 108*b* cannot be removed from the first post 106*a*. Therefore, it can be said that the first large chain-link ring 116*a* cannot be removed from the first post 106*a* and has its movable range defined by the second small ring 108*b*.

As with the second embodiment, the movable range of the third small ring 108*c* is defined by the second small ring 108*b*.

[Solution to Wisdom Ring Puzzle 5]

In the following, the solution of the wisdom ring puzzle 5 in the fifth embodiment of the present invention is described.

First, as depicted in FIG. 16, from a state in which the first member 100 and the second member 200 configuring the wisdom ring puzzle 5 are separated from each other (step S501), pass the disconnection prevention part 104, the first post 106*a*, the second post 106*b*, the third post 106*c*, the first small ring 108*a*, the second small ring 108*b*, the third small ring 108*c*, and the first large chain-link ring 116*a* of the first member 100 through the ring of the second member 200 to bring about a state in which the disconnection prevention part 104, the first post 106*a*, the second post 106*b*, and the third post 106*c* pass through the ring of the second member 200. Next, pass the second member 200 through a space between the first small ring 108*a* and the disconnection prevention part 104 positioned on a left side of the disconnection prevention part 104 and a space between the first large chain-link ring 116*a* and the disconnection prevention part 104 positioned on the left side of the disconnection prevention part 104 (step S503). To implement the solution of the wisdom ring puzzle 5 described below, the connection post 102 may pass through the second member 200 as appropriate.

Next, after removing the disconnection prevention part 104 from the ring of the second member 200, remove the second member 200 from the first large chain-link ring 116*a* and the first small ring 108*a* (step S505). In other words, make a transition from a state in which the disconnection prevention part 104 passes through the ring of the second member 200 to a state in which it does not pass therethrough, and further make a transition from a state in which the second member 200 passes through the first large chain-link ring 116*a* and the first small ring 108*a* to a state in which it does not pass therethrough.

At the time when the operation in step S505 ends, the first post 106*a*, the second post 106*b*, and the third post 106*c* pass through the ring of the second member 200 and the disconnection prevention part 104 does not pass therethrough.

Next, pass the second member 200 through the first large chain-link ring 116*a*, a space between the second small ring 108*b* and the first post 106*a* positioned on a left side of the first post 106*a*, and the first small ring 108*a* (step S507). With this operation, it can also be said that the second member 200 passes through the first large chain-link ring 116*a*, the second small ring 108*b*, and the first small ring 108*a*.

Next, after passing the disconnection prevention part 104 through the ring of the second member 200, remove the second member 200 in the state of passing through the first small ring 108*a* by the operation in step S507 from the first small ring 108*a* (step S509). With this operation, the state becomes such that the second member 200 does not pass through the first small ring 108*a* but passes through the first large chain-link ring 116*a* and the second small ring 108*b*.

Next, after passing the first small ring 108*a* through the ring of the second member 200, remove the disconnection prevention part 104 from the ring of the second member 200, and remove the second member 200 from the second small ring 108*b* and the first large chain-link ring 116*a* (step S511). With this operation, the state becomes such that the second post 106*b* and the third post 106*c* pass through the second member 200 and the disconnection prevention part 104 and the first post 106*a* do not pass through the second member 200.

Next, after passing the second member 200 through a space between the third small ring 108*c* and the second post 106*b* positioned on a left side of the second post 106*b* and the second small ring 108*b*, pass the disconnection prevention part 104 and the first small ring 108*a* through the ring of the second member 200 (step S513).

Next, after passing second member 200 through a space between the first small ring 108*a* and the disconnection prevention part 104 positioned on a left side of the disconnection prevention part 104, remove the disconnection prevention part 104 from the ring of the second member 200, and remove the second member 200 from the first small ring 108*a* and the second small ring 108*b* (step S515). With this operation, the state becomes such that the second member 200 still passes through the third small ring 108*c* and the first post 106*a*, the second post 106*b*, and the third post 106*c* pass through the second member 200.

Next, pass the second member 200 through the first small ring 108*a* (step S517). Here, do not pass it through the second small ring 108*b*.

Next, after passing the disconnection prevention part 104 through the second member 200, remove the second member 200 from the first small ring 108*a* (step S519).

Next, after passing the first small ring 108*a* and the second small ring 108*b* through the second member 200, remove the disconnection prevention part 104, first post 106*a*, and the second post 106*b* from the second member 200, and remove the second member 200 from the third small ring 108*c* (step S521). With this operation, the state becomes such that only the third post 106*c* passes through the second member 200 and the disconnection prevention part 104, the first post 106*a*, and the second post 106*b* do not pass through the second member 200.

As described above, in the wisdom ring puzzle 5 according to the fifth embodiment, by performing operation as appropriate from the state in which the first member 100 and the second member 200 are separated from each other (refer to FIG. 16), a transition can be made to a state in which the third post 106*c* of the first member 100 passes through the second member 200 but the disconnection prevention part 104, the first post 106*a*, and the second post 106*b* do not pass. It is also possible, as a matter of course, to perform its reverse operation.

In this manner, as with the first to fourth embodiments, since the wisdom ring puzzle 5 in the fifth embodiment of the present invention has a structure not in conventional wisdom ring puzzles, a solution not in the conventional wisdom ring puzzles is required, and interests and eagerness can be maintained for a long period of time.

Sixth Embodiment

[Structure of Wisdom Ring Puzzle 6]

Figure 17:
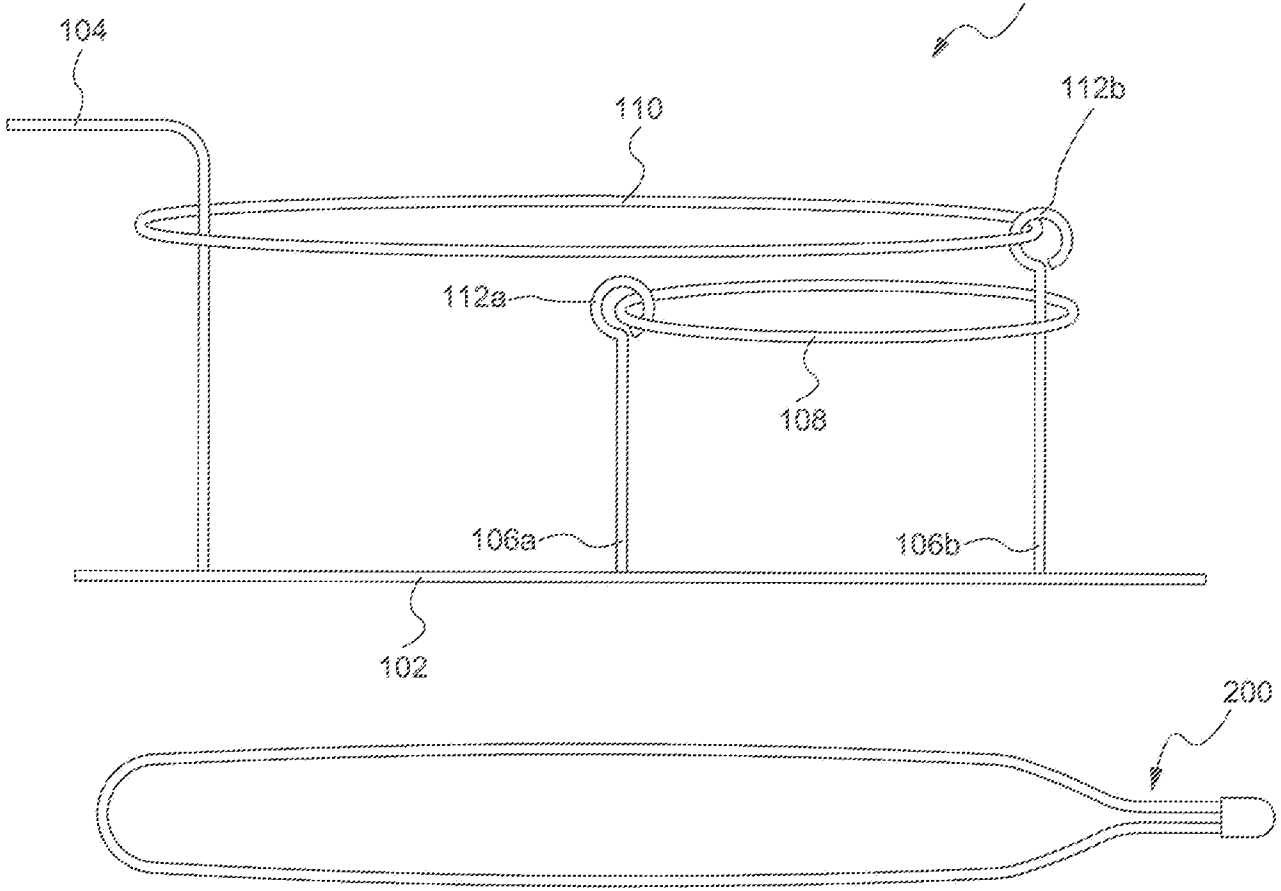
FIG. 17 is a diagram describing the structure of a wisdom ring puzzle in one embodiment of the present invention.

FIG. 17 is a diagram describing the structure of a first member 100 of a wisdom ring puzzle 6 in a sixth embodiment of the present invention. The wisdom ring puzzle 6 in the sixth embodiment includes the first member 100 and the second member 200. The first member 100 includes the connection post 102, the disconnection prevention part 104, the first post 106*a*, the second post 106*b*, a small ring 108, and a large ring 110. Portions where the description of the structures of the wisdom ring puzzles in the first to five embodiments is commonly applied are omitted.

The disconnection prevention part 104, the first post 106*a*, and the second post 106*b* are sequentially provided to extend from the connection post 102 toward a substantially same direction.

The first ring catching part 112*a* of the first post 106*a* swingably catches the small ring 108 in the first post 106*a*.

The second post 106*b* passes through the small ring 108, and has the second ring catching part 112*b* at a further extended position. The second ring catching part 112*b* swingably catches the large ring 110 in the second post 106*b*. Through this large ring 110, the disconnection prevention part 104 passes, and the large ring 110 cannot be removed from the disconnection prevention part 104. That is, the large ring 110 cannot move so as to make a transition from a state in which the disconnection prevention part 104 passes through the large ring 110 to a state in which it does not pass therethrough. In this manner, the large ring 110 can move while maintaining the state of being caught in the second post 106*b* by the second ring catching part 112*b* but has its movable range defined by the disconnection prevention part 104.

[Solution to Wisdom Ring Puzzle 6]

In the following, the solution of the wisdom ring puzzle 6 in the sixth embodiment of the present invention is described.

First, as depicted in FIG. 17, from a state in which the first member 100 and the second member 200 configuring the wisdom ring puzzle 6 are separated from each other (step S601), pass the second member 200 through a space between the small ring 108 and the second post 106*b* on a right side of the second post 106*b* (step S603). Furthermore, pass the second post 106*b*, the large ring 110, and the disconnection prevention part 104 through the ring of the second member 200 (step S605). Then, pass the second member 200 through a space between the disconnection prevention part 104 and the large ring 110 on a left side of the disconnection prevention part 104 (step S607).

When the disconnection prevention part 104 in the state of passing through the ring of the second member 200 by the operation in step S605 is removed from the ring of the second member 200 and the second member 200 is removed from the large ring 110 and the small ring 108, the state becomes such that the connection post 102 passes through the ring of the second member 200 (step S609).

In this manner, in the wisdom ring puzzle 6 in the sixth embodiment, by performing operation as appropriate from the state in which the first member 100 and the second member 200 are separated from each other (FIG. 17), a transition can be made to a state in which the connection post 102 passes through the second member 200. It is also possible, as a matter of course, to perform its reverse operation.

In this manner, as with the wisdom ring puzzles in the first to fifth embodiments, since the wisdom ring puzzle 6 in the sixth embodiment of the present invention has a structure not in conventional wisdom ring puzzles, a solution not in the conventional wisdom ring puzzles is required, and interests and eagerness can be maintained for a long period of time.

Seventh Embodiment

[Structure of Wisdom Ring Puzzle 7]

Figure 18:
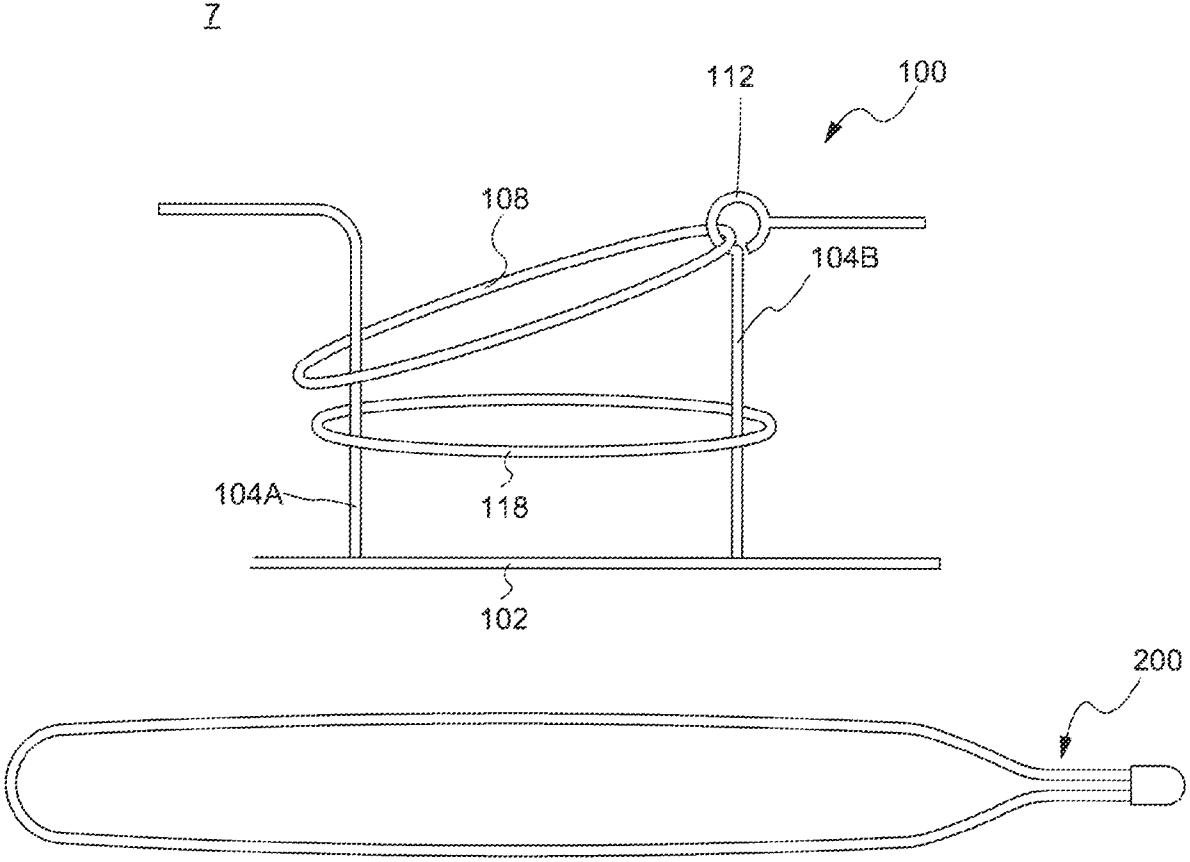
FIG. 18 is a diagram describing the structure of a wisdom ring puzzle in one embodiment of the present invention.

FIG. 18 is a diagram describing the structure of a first member 100 of a wisdom ring puzzle 7 in a seventh embodiment of the present invention. The wisdom ring puzzle 7 in the seventh embodiment includes the first member 100 and the second member 200. The first member 100 includes the connection post 102, a first disconnection prevention part 104A, a second disconnection prevention part 1048, the small ring 108, and a free ring 118. Portions where the description of the structures of the wisdom ring puzzles in the first to sixth embodiments is commonly applied are omitted.

As with the small ring 108, the free ring 118 is an annular member.

The first disconnection prevention part 104A and the second disconnection prevention part 1048 are sequentially provided to extend from the connection post 102 toward a substantially same direction, and each pass through the free ring 118. At a further extended position, the second disconnection prevention part 1048 has a ring catching part 112.

In the seventh embodiment, the first disconnection prevention part 104A and the second disconnection prevention part 1048 pass through the free ring 118 to define their movable ranges. That is, the first disconnection prevention part 104A and the second disconnection prevention part 104B pass through the free ring 118, and maintains a state in which the first disconnection prevention part 104A and the second disconnection prevention part 104B pass through the free ring 118. It can also be said that the first disconnection prevention part 104A and the second disconnection prevention part 1048 function so that the free ring 118 is not removed from the first post 106*a* and the second post 106*b*. In one embodiment, the first disconnection prevention part 104A and the second disconnection prevention part 1048 depicted in FIG. 18 are each shaped to pass the free ring 118 and be curved at a further extended location to a direction away from each other.

The ring catching part 112 of the second disconnection prevention part 1048 catches the small ring 108 in the second disconnection prevention part 1048. The first disconnection prevention part 104A passes through the free ring 118 as described above, and passes also through the small ring 108 to define its movable range. That is, the first disconnection prevention part 104A passes through the free ring 118 and the small ring 108 to function so that the first disconnection prevention part 104A is not removed from the free ring 118 and the small ring 108.

[First Solution to Wisdom Ring Puzzle 7]

In the following, a first solution of the wisdom ring puzzle 7 in the seventh embodiment of the present invention is described.

First, from a state in which the first member 100 and the second member 200 configuring the wisdom ring puzzle 7 are separated from each other (step S701), pass the second member 200 through a space between the second disconnection prevention part 104B and the free ring 118 on a right side of the second disconnection prevention part 104B (step S703). Furthermore, pass the second disconnection prevention part 104B, the small ring 108, and the first disconnection prevention part 104A through the ring of the second member 200 (step S705).

Next, while maintaining the state in which the second member 200 passes through the free ring 118, pass the second member 200 through a space between the first disconnection prevention part 104A and the small ring 108 on a left side of the first disconnection prevention part 104A (step S707), further remove the first disconnection prevention part 104A from the ring of the second member 200, and remove the second member 200 from the small ring 108 and the free ring 118. This brings about a state in which the connection post 102 passes through the second member (step S709).

In this manner, in the wisdom ring puzzle 7 in the seventh embodiment, by performing operation as appropriate from the state in which the first member 100 and the second member 200 are separated from each other (FIG. 18), a transition can be made to a state in which the connection post 102 passes through the second member 200. It is also possible, as a matter of course, to perform its reverse operation.

[Second Solution to Wisdom Ring Puzzle 7]

In the following, a second solution of the wisdom ring puzzle 7 in the seventh embodiment of the present invention is described.

First, from a state in which the first member 100 and the second member 200 configuring the wisdom ring puzzle 7 are separated from each other (step S801), pass the second member 200 through a space between the free ring 118 and the first disconnection prevention part 104A on a left side of the first disconnection prevention part 104A (step S803). Then, by the same method as the method described in step S707 to step S709, the state can make a transition to the state in which the connection post 102 passes through the second member 200. It is also possible, as a matter of course, to perform its reverse operation.

In this manner, as with the wisdom ring puzzles in the first to sixth embodiments, since the wisdom ring puzzle 7 in the seventh embodiment of the present invention has a structure not in conventional wisdom ring puzzles, a solution not in the conventional wisdom ring puzzles is required, and interests and eagerness can be maintained for a long period of time.

Eighth Embodiment

[Structure of Wisdom Ring Puzzle 8]

Figure 19:
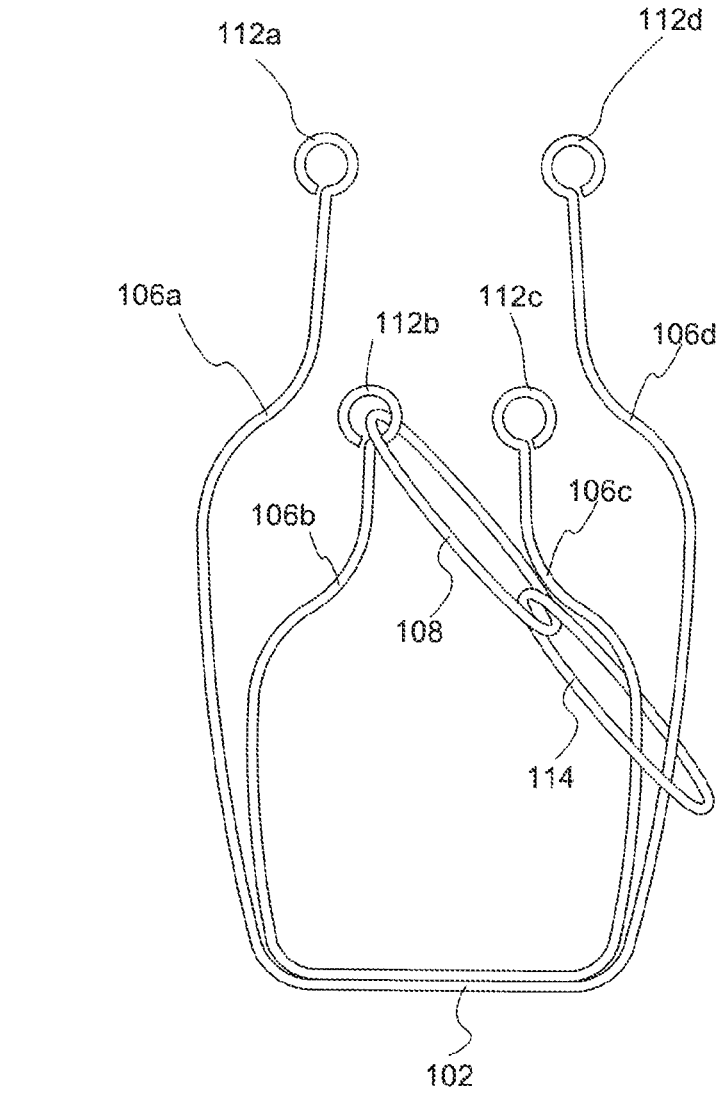
FIG. 19 is a diagram describing the structure of a wisdom ring puzzle in one embodiment of the present invention.

FIG. 19 is a diagram describing the structure of a first member 100 of a wisdom ring puzzle 8 in an eighth embodiment of the present invention. The wisdom ring puzzle 8 in the eighth embodiment includes the first member 100 and the second member 200. The first member 100 includes the connection post 102, the first post 106*a*, the second post 106*b*, the third post 106*c*, a fourth post 106*d*, the small ring 108, and a chain-link ring 114. Portions where the description of the structures of the wisdom ring puzzles in the first to seventh embodiments is commonly applied are omitted.

In the eighth embodiment, as depicted in FIG. 19, description is made as the first post 106*a* and the fourth post 106*d* are longer than the second post 106*b* and the third post 106*c* and each post 106 is mildly curved. However, the shape of each post 106 is not limited to this, and any shape can be taken which can implement the solution to the wisdom ring puzzle 1 described in the specification.

By the second ring catching part 112*b* of the second post 106*b*, the small ring 108 is swingably caught in the second post 106*b*. Also, the small ring 108 mutually connects to the chain-link ring 114. And, while any post 106 does not pass through the small ring 108, the third post 106*c* and the fourth post 106*d* pass through the chain-link ring 114.

[Solution to Wisdom Ring Puzzle 8]

In the following, the solution of the wisdom ring puzzle 8 in the eighth embodiment of the present invention is described.

First, from a state in which the first member 100 and the second member 200 configuring the wisdom ring puzzle 8 are separated from each other (step S901), pass the second member 200 through the chain-link ring 114 (step S903). Furthermore, pass the fourth post 106*d* and the third post 106*c* through the ring of the second member 200 (step S905), further move them, and remove the second member 200 from the chain-link ring 114. This brings about a state in which the connection post 102 passes through the second member 200 (step S907). In the solution to the wisdom ring puzzle 8 in the eighth embodiment of the present invention, it is not required to pass the second member 200 through the small ring 108.

In this manner, in the wisdom ring puzzle 8 in the eighth embodiment, by performing operation as appropriate from the state in which the first member 100 and the second member 200 are separated from each other (FIG. 19), a transition can be made to a state in which the connection post 102 passes through the second member 200. It is also possible, as a matter of course, to perform its reverse operation.

In this manner, as with the wisdom ring puzzles in the first to seventh embodiments, since the wisdom ring puzzle 8 in the eighth embodiment of the present invention has a structure not in conventional wisdom ring puzzles, a solution not in the conventional wisdom ring puzzles is required, and interests and eagerness can be maintained for a long period of time.

Ninth Embodiment

[Structure of Wisdom Ring Puzzle 9]

Figure 20:
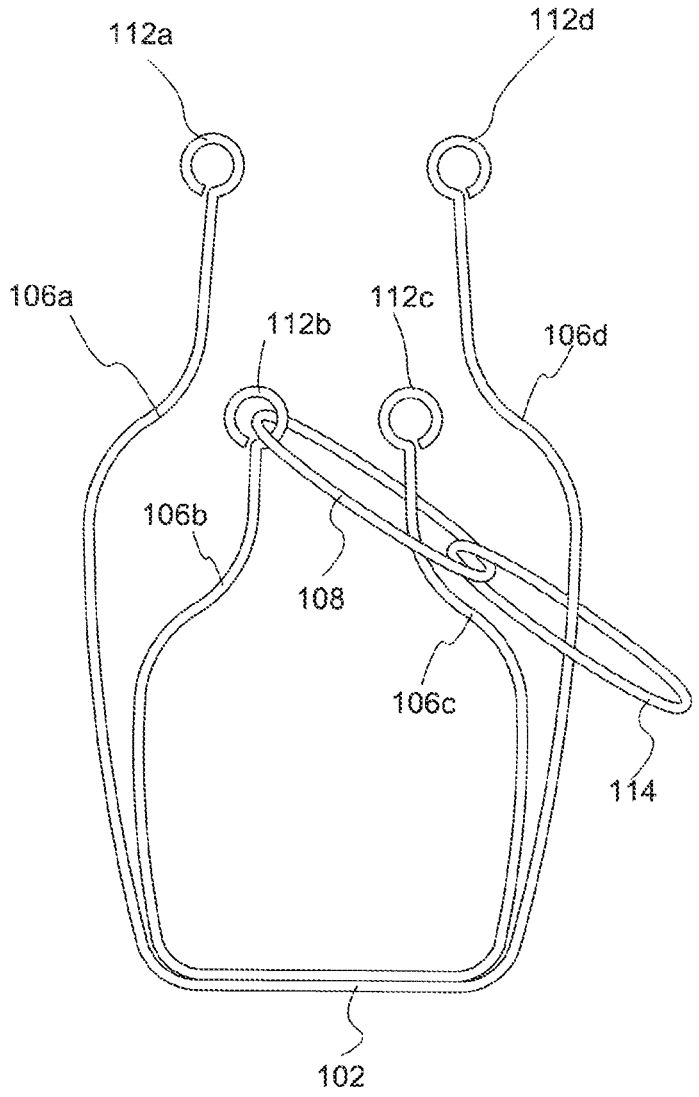
FIG. 20 is a diagram describing the structure of a wisdom ring puzzle in one embodiment of the present invention.

FIG. 20 is a diagram describing the structure of a wisdom ring puzzle 9 in a ninth embodiment of the present invention. In the ninth embodiment, the third post 106*c* passes through the small ring 108 swingably caught in the second post 106*b* by the second ring catching part 112*b* included in the second post 106*b*, and the fourth post 106*d* passes through the chain-link ring 114 which mutually connects to the small ring 108. Description of the others is common to the description of the structure of the wisdom ring puzzle 8 in the eighth embodiment and thus is omitted.

[Solution to Wisdom Ring Puzzle 9]

In the following, the solution of the wisdom ring puzzle 9 in the ninth embodiment of the present invention is described.

First, from a state in which the first member 100 and the second member 200 configuring the wisdom ring puzzle 9 are separated from each other (step S1001), pass the second member 200 through the chain-link ring 114 (step S1003).

Furthermore, pass the fourth post 106*d* through the ring of the second member 200 (step S1005). Still further, while the state of the fourth post 106*d* passing through the ring of the second member 200 is maintained, remove the second member 200 from the chain-link ring 114 (step S1007). Here, the second member 200 is positioned between the third post 106*c* and the fourth post 106*d*.

Next, pass the second member 200 through a space between the third post 106*c* and the small ring 108 on a right side of the third post 106*c* (step S1009). In other words, pass the second member 200 through the small ring 108. Then, pass the third post 106*c* through the ring of the second member 200 (step S1011). Furthermore, remove the second member 200 from the small ring 108. This brings about a state in which the connection post 102 passes through the ring of the second member 200 (step S1013).

In this manner, in the wisdom ring puzzle 9 in the ninth embodiment, by performing operation as appropriate from the state in which the first member 100 and the second member 200 are separated from each other (FIG. 20), a transition can be made to a state in which the connection post 102 passes through the second member 200. It is also possible, as a matter of course, to perform its reverse operation.

In this manner, as with the wisdom ring puzzles in the first to eighth embodiments, since the wisdom ring puzzle 9 in the ninth embodiment of the present invention has a structure not in conventional wisdom ring puzzles, a solution not in the conventional wisdom ring puzzles is required, and interests and eagerness can be maintained for a long period of time.

Tenth Embodiment

[Structure of Wisdom Ring Puzzle 10]

Figure 21:
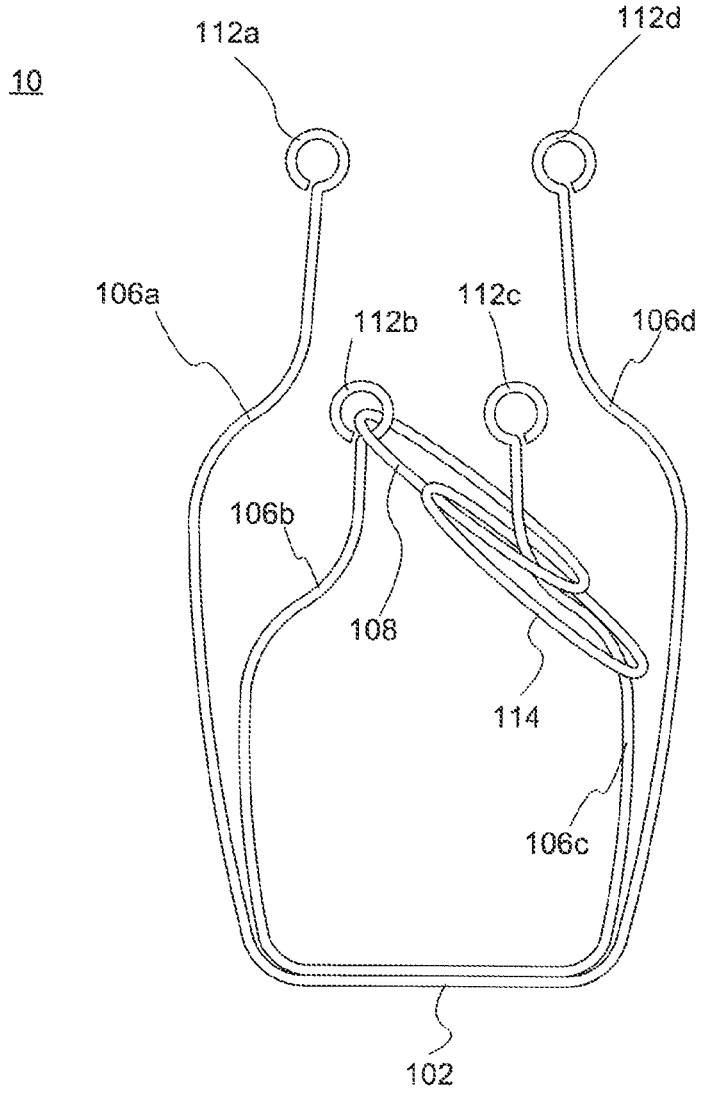
FIG. 21 is a diagram describing the structure of a wisdom ring puzzle in one embodiment of the present invention.

FIG. 21 is a diagram describing the structure of a wisdom ring puzzle 10 in a tenth embodiment of the present invention. In the tenth embodiment, the third post 106*c* passes through the small ring 108 swingably caught in the second post 106*b* by the second ring catching part 112*b* included in the second post 106*b* and through the chain-link ring 114 which mutually connects to the small ring 108. Description of the others is common to the description of the structure of the wisdom ring puzzle 8 in the eighth embodiment and thus is omitted.

[Solution to Wisdom Ring Puzzle 10]

In the following, the solution of the wisdom ring puzzle 10 in the tenth embodiment of the present invention is described.

First, from a state in which the first member 100 and the second member 200 configuring the wisdom ring puzzle 10 are separated from each other (step S1101), pass the fourth post 106*d* through the ring of the second member 200 (step S1103).

Next, pass the second member 200 through a space between the third post 106*c* and the chain-link ring 114 on a right side of the third post 106*c* (step S1105), and further pass it through a space between the third post 106*c* and the small ring 108 on the right side of the third post 106*c* (step S1107). Then, pass the third post 106*c* through the ring of the second member 200 (step S1109). Furthermore, remove the second member 200 from the small ring 108 and the chain-link ring 114. This brings about a state in which the connection post 102 passes through the second member 200 (step S1111).

In this manner, in the wisdom ring puzzle 10 in the tenth embodiment, by performing operation as appropriate from the state in which the first member 100 and the second member 200 are separated from each other (FIG. 21), a transition can be made to a state in which the connection post 102 passes through the second member 200. It is also possible, as a matter of course, to perform its reverse operation.

In this manner, as with the wisdom ring puzzles in the first to ninth embodiments, since the wisdom ring puzzle 10 in the tenth embodiment of the present invention has a structure not in conventional wisdom ring puzzles, a solution not in the conventional wisdom ring puzzles is required, and interests and eagerness can be maintained for a long period of time.

Eleventh Embodiment

[Structure of Wisdom Ring Puzzle 11]

Figure 22:
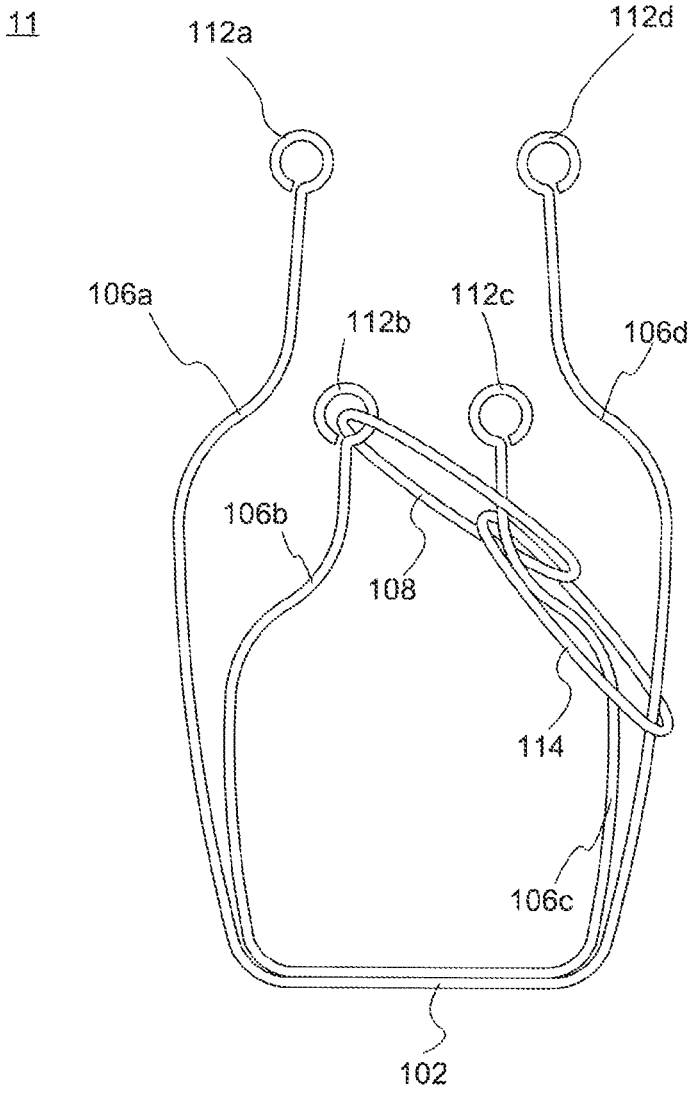
FIG. 22 is a diagram describing the structure of a wisdom ring puzzle in one embodiment of the present invention.

FIG. 22 is a diagram describing the structure of a wisdom ring puzzle 11 in an eleventh embodiment of the present invention. In the eleventh embodiment, the third post 106*c* passes through the small ring 108 swingably caught in the second post 106*b* by the second ring catching part 112*b* included in the second post 106*b* and through the chain-link ring 114 which mutually connects to the small ring 108 and, furthermore, the fourth post 106*d* passes through the chain-link ring 114. Description of the others is common to the description of the structure of the wisdom ring puzzle 8 in the eighth embodiment and thus is omitted.

[Solution to Wisdom Ring Puzzle 11]

In the following, the solution of the wisdom ring puzzle 11 in the eleventh embodiment of the present invention is described.

First, from a state in which the first member 100 and the second member 200 configuring the wisdom ring puzzle 11 are separated from each other (step S1201), pass the second member 200 through the chain-link ring 114 (step S1203). Furthermore, pass the fourth post 106*d* through the ring of the second member 200 (step S1205).

Next, pass the second member 200 through a space between the third post 106*c* and the small ring 108 on a right side of the third post 106*c* (step S1207). The operation in this step S1207 is performed in a state in which the second member 200 passes through the chain-link ring 114. That is, when the operation in step S1207 is performed, the second member 200 passes through both of the chain-link ring 114 and the small ring 108.

Then, pass the third post 106*c* through the ring of the second member 200 (step S1209). Furthermore, remove the second member 200 from the small ring 108 and the chain-link ring 114. This brings about a state in which the connection post 102 passes through the second member 200 (step S1211).

In this manner, in the wisdom ring puzzle 11 in the eleventh embodiment, by performing operation as appropriate from the state in which the first member 100 and the second member 200 are separated from each other (FIG. 22), a transition can be made to a state in which the connection post 102 passes through the second member 200. It is also possible, as a matter of course, to perform its reverse operation.

In this manner, as with the wisdom ring puzzles in the first to tenth embodiments, since the wisdom ring puzzle 11 in the eleventh embodiment of the present invention has a structure not in conventional wisdom ring puzzles, a solution not in the conventional wisdom ring puzzles is required, and interests and eagerness can be maintained for a long period of time.

Twelfth Embodiment

[Structure of Wisdom Ring Puzzle 12]

Figure 23:
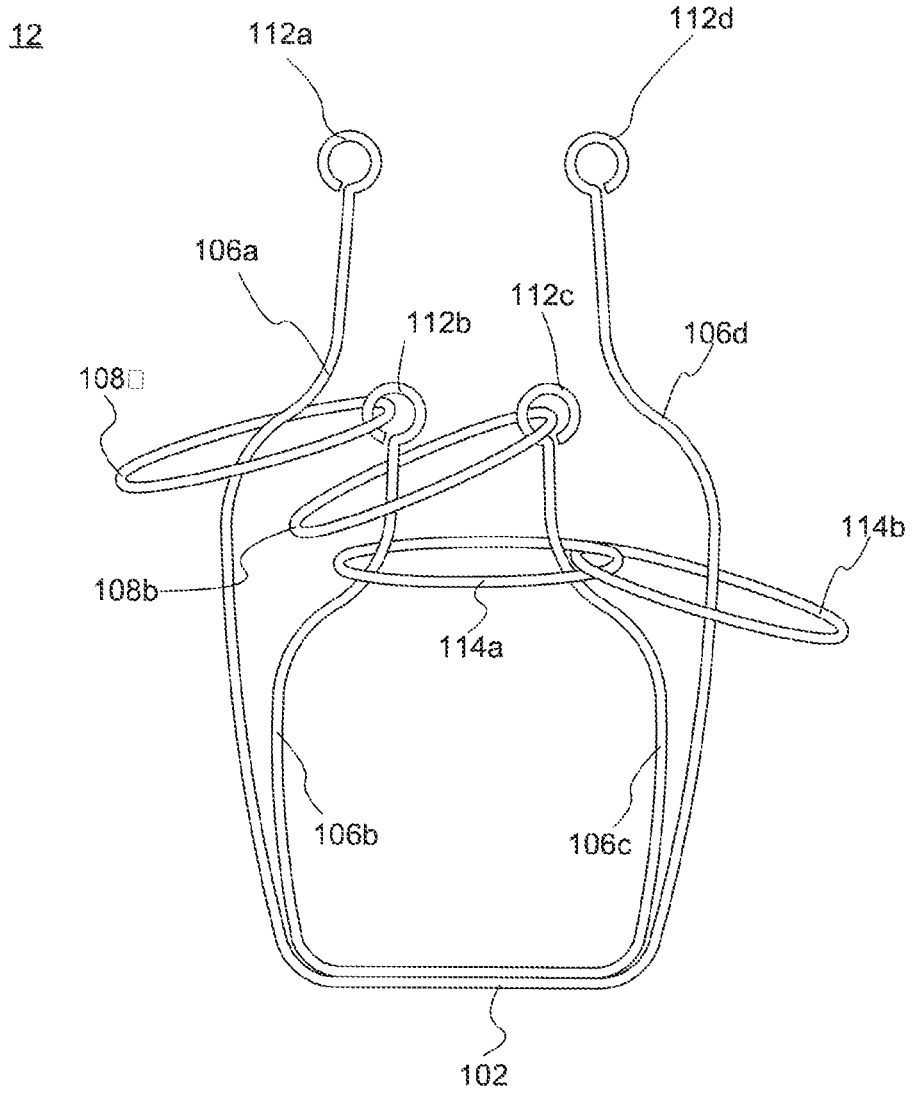
FIG. 23 is a diagram describing the structure of a wisdom ring puzzle in one embodiment of the present invention.

FIG. 23 is a diagram describing the structure of a wisdom ring puzzle 12 in a twelfth embodiment of the present invention. The wisdom ring puzzle 12 in the twelfth embodiment includes the first small ring 108*a*, the second small ring 108*b*, the first chain-link ring 114*a*, and the second chain-link ring 114*b* which mutually connects to the first chain-link ring 114*a*. Redundant description of the structure of the wisdom ring puzzle 8 in the eighth embodiment is omitted.

In the twelfth embodiment, the first post 106*a* passes through the first small ring 108*a*, and the first small ring 108*a* is swingably caught in the second post 106*b* by the second ring catching part 112*b*. Also, the second post 106*b* passes through the second small ring 108*b*, and the second small ring 108*b* is swingably caught in the third post 106*c* by the third ring catching part 112*c*.

The first chain-link ring 114*a* mutually connects to the second chain-link ring 114*b*. The second post 106*b* and the third post 106*c* pass through the first chain-link ring 114*a*, and the fourth post 106*d* passes through the second chain-link ring 114*b*. In this example, it is assumed that the second post 106*b* extends from the connection post 102, passes through the first chain-link ring 114*a*, passes through the second small ring 108*b*, and has the second ring catching part 112*b* at a further extended position.

[First Solution to Wisdom Ring Puzzle 12]

In the following, a first solution of the wisdom ring puzzle 12 in the twelfth embodiment of the present invention is described.

First, from a state in which the first member 100 and the second member 200 configuring the wisdom ring puzzle 12 are separated from each other (step S1301), pass the second member 200 through the second chain-link ring 114*b* (step S1303). Furthermore, pass the fourth post 106*d* through the ring of the second member 200 (step S1305). While maintaining the state in which the fourth post 106*d* passes through the ring of the second member 200, remove the second member 200 from the second chain-link ring 114*b* (step S1307). Here, the second member 200 is positioned between the third post 106*c* and the fourth post 106*d*.

Next, pass the second member 200 through the first chain-link ring 114*a* (step S1309) and, furthermore, pass the first post 106*a*, the first small ring 108*a*, and the second small ring 108*b* through the ring of the second member 200 (step S1311).

Next, pass the second member 200 through a space between the first small ring 108*a* and the first post 106*a* on a left side of the first post 106*a* (step S1313) and, furthermore, remove the first post 106*a* from the ring of the second member 200 and remove the second member 200 from the first small ring 108*a* and the first chain-link ring 114*a* (step S1315).

Next, pass the second member 200 through the first chain-link ring 114*a*, second small ring 108*b*, and the first small ring 108*a* (step S1317) and, furthermore, pass first post 106*a* through the second member 200 (step S1319).

Next, remove the second member 200 from the first small ring 108*a* (step S1321), and pass the first small ring 108*a* through the ring of the second member 200 (step S1323). Then, remove the first post 106*a* from the ring of the second member 200 (step S1325), and remove the second member 200 from the second small ring 108*b* and the first chain-link ring 114*a*. This brings about a state in which the connection post 102 passes through the second member 200 (step S1327).

In this manner, in the wisdom ring puzzle 12 in the twelfth embodiment, by performing operation as appropriate from the state in which the first member 100 and the second member 200 are separated from each other (FIG. 23), a transition can be made to a state in which the connection post 102 passes through the second member 200. It is also possible, as a matter of course, to perform its reverse operation.

[Second Solution to Wisdom Ring Puzzle 12]

In the following, a second solution of the wisdom ring puzzle 12 in the twelfth embodiment of the present invention is described.

First, from a state in which the first member 100 and the second member 200 configuring the wisdom ring puzzle 12 are separated from each other (step S1401), pass the second member 200 through a space between the first small ring 108*a* and the first post 106*a* on a left side of the first post 106*a* (step S1403). Then, by the same method as the method described in step S1315 to step S1327, the state becomes such that the connection post 102 passes through the second member 200.

In this manner, in the wisdom ring puzzle 12 in the twelfth embodiment, by performing operation as appropriate from the state in which the first member 100 and the second member 200 are separated from each other (FIG. 23) by two methods, a transition can be made to a state in which the connection post 102 passes through the second member 200. It is also possible, as a matter of course, to perform its reverse operation.

In this manner, as with the wisdom ring puzzles in the first to eleventh embodiments, since the wisdom ring puzzle 12 in the twelfth embodiment of the present invention has a structure not in conventional wisdom ring puzzles, a solution not in the conventional wisdom ring puzzles is required, and interests and eagerness can be maintained for a long period of time.

Thirteenth Embodiment

[Structure of Wisdom Ring Puzzle 13]

Figure 24:
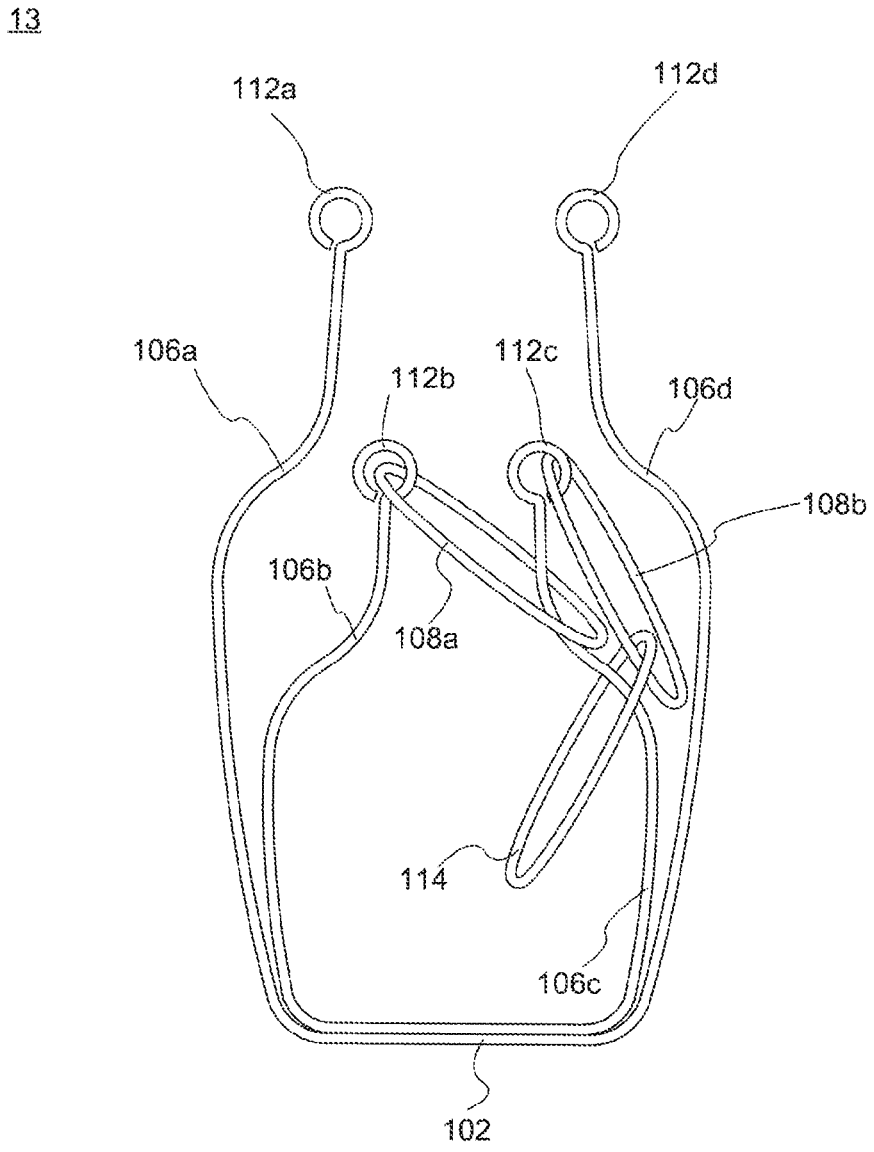
FIG. 24 is a diagram describing the structure of a wisdom ring puzzle in one embodiment of the present invention.

FIG. 24 is a diagram describing the structure of a wisdom ring puzzle 13 in a thirteenth embodiment of the present invention. In the thirteenth embodiment, the first small ring 108*a* is swingably caught in the second post 106*b*, and the second small ring 108*b* is swingably caught in the third post 106*c*. Also, the second small ring 108*b* and the chain-link ring 114 are mutually connected. And, the third post 106*c* extends from the connection post 102, passes through the chain-link ring 114, passes through the first small ring 108*a*, and has the third ring catching part 112*c* at a further extended position to swingably catch the second small ring 108*b*.

In the wisdom ring puzzle 13 having this structure, with operation in a state in which the first member 100 and the second member 200 are separated from each other, a transition cannot be made to a state in which the connection post 102 passes through the second member 200.

Based on the wisdom ring puzzles as embodiments according to the present invention, those with addition, deletion, or a design change of a component performed as appropriate by a person skilled in the art or those with addition, omission, or a condition change of a step are included in the scope of the present invention as long as they have the gist of the present invention. Also, the above-described embodiments can be mutually combined in a range not causing a technical contradiction.

Also, other operations and effects that are different from the operations and effects brought by the modes of the above-described embodiments are construed as being naturally brought by the present invention as long as they are clear from the description of the specification and so forth or can be easily predicted by a person skilled in the art.

Since the wisdom ring puzzle of this invention has a structure not in conventional wisdom ring puzzles, a solution not in the conventional wisdom ring puzzles is required, and interests and eagerness can be maintained for a long period of time.

What is claimed is:

1. A wisdom ring puzzle comprising:

a first member; and a second member being an annular member, wherein the first member includes a connection post, a first small ring, a second small ring, and a first large ring, the first member includes a disconnection prevention part, a first post, and a second post sequentially provided to extend from the connection post toward a substantially same direction, the first post includes a first ring catching part, the second post includes a second ring catching part, the first small ring is swingably caught in the first post by the first ring catching part, the second small ring and the first large ring are swingably caught in the second post by the second ring catching part, the disconnection prevention part passes through the first small ring and the first large ring, the first post passes through the second small ring, movable ranges of the first small ring and the first large ring are defined by the disconnection prevention part, and a movable range of the second small ring is defined by the first small ring.

2. The wisdom ring puzzle according to claim 1, wherein a major axis of the first large ring is twice as long as major axes of the first small ring and the second small ring or longer.

3. The wisdom ring puzzle according to claim 1, wherein the first member further includes a third small ring, a second large ring, and a third post, the third post is sequentially provided to extend from the connection post on a side opposite to the first post when viewed from the second post toward a substantially same direction as that of the second post, the third post includes a third ring catching part, the third small ring and the second large ring are swingably caught in the third post by the third ring catching part, the first post further passes through the second large ring, the second post passes the second large ring and the third small ring, a movable range of the second large ring is defined by the first small ring, and a movable range of the third small ring is defined by the second small ring.

4. A wisdom ring puzzle comprising:

a first member; and a second member being an annular member, wherein the first member includes a connection post, a first small ring, and a second small ring and a first chain-link ring which are mutually connected, and the first member includes a disconnection prevention part, a first post, and a second post sequentially provided to extend from the connection post toward a substantially same direction, the first post includes a first ring catching part, the second post includes a second ring catching part, the first small ring is swingably caught in the first post by the first ring catching part, the second small ring is swingably caught in the second post by the second ring catching part, the disconnection prevention part passes through the first small ring and the first chain-link ring, the first post passes through the second small ring, movable ranges of the first small ring and the first chain-link ring are defined by the disconnection prevention part, and a movable range of the second small ring is defined by the first small ring.

5. A wisdom ring puzzle comprising:

a first member; and a second member being an annular member, wherein the first member includes a connection post, a first small ring, and a second small ring, a third small ring, a first chain-link ring, and a second chain-link ring which mutually connect the third small ring and the first chain-link ring, and the first member includes a disconnection prevention part, a first post, a second post, and a third post sequentially provided to extend from the connection post toward a substantially same direction, the first post includes a first ring catching part, the second post includes a second ring catching part, the third post includes a third ring catching part, the first small ring is swingably caught in the first post by the first ring catching part, the second small ring is swingably caught in the second post by the second ring catching part, the third small ring is swingably caught in the second post by the third ring catching part, the disconnection prevention part passes through the first small ring and the first chain-link ring, the first post passes through the second small ring and the second chain-link ring, movable ranges of the first small ring and the first chain-link ring are defined by the disconnection prevention part, movable ranges of the second small ring, the first chain-link ring, and the second chain-link ring are defined by the first small ring, and movable ranges of the third small ring and the second chain-link ring are defined by the second small ring.

6. A wisdom ring puzzle comprising:

a first member; and a second member being an annular member, wherein the first member includes a connection post, a first small ring, a second small ring, a third small ring, and a first large chain-link ring which mutually connects to the third small ring, the first member includes a disconnection prevention part, a first post, a second post, and a third post sequentially provided to extend from the connection post toward a substantially same direction, the first post includes a first ring catching part,
the second post includes a second ring catching part,
the third post includes a third ring catching part,
the first small ring is swingably caught in the first post by the first ring catching part,
the second small ring is swingably caught in the second post by the second ring catching part,
the third small ring is swingably caught in the third post by the third ring catching part,
the disconnection prevention part passes through the first small ring and the first large chain-link ring,
the first post passes through the second small ring and the first large chain-link ring,
the second post passes through the third small ring,
movable ranges of the first small ring and the first large chain-link ring are defined by the disconnection prevention part,
a movable range of the second small ring is defined by the first small ring, and
movable ranges of the third small ring and the first large chain-link ring are defined by the second small ring.

7. A wisdom ring puzzle comprising:
a first member; and
a second member being an annular member,
wherein the first member includes a connection post, a small ring, and a large ring,
the first member includes a disconnection prevention part, a first post, and a second post sequentially provided to extend from the connection post toward a substantially same direction,
the first post includes a first ring catching part,
the second post includes a second ring catching part,
the small ring is swingably caught in the first post by the first ring catching part,
the large ring is swingably caught in the second post by the second ring catching part,
the disconnection prevention part passes through the large ring,
the second post passes through the small ring, and
a movable range of the large ring is defined by the disconnection prevention part.

8. A wisdom ring puzzle comprising:
a first member; and
a second member being an annular member,
wherein the first member includes a connection post, a small ring, and a free ring,
the first member includes a first disconnection prevention part and a second disconnection prevention part sequentially provided to extend from the connection post toward a substantially same direction,
the second disconnection prevention part includes a ring catching part,
the small ring is swingably caught in the second disconnection prevention part by the ring catching part,
the first disconnection prevention part passes through the free ring and the small ring,
the second disconnection prevention part passes through the free ring,
the first disconnection prevention part and the second disconnection prevention part are each shaped to pass the free ring and are curved at a further extended location to a direction away from each other to prevent the free ring from removing from the first disconnection prevention part and the second disconnection prevention part,
a movable range of the free ring is defined by the first disconnection prevention part and the second disconnection prevention part, and
a movable range of the small ring is defined by the first disconnection prevention part.

* * * * *